US010930160B2

(12) United States Patent
Valls Hernandez et al.

(10) Patent No.: US 10,930,160 B2
(45) Date of Patent: Feb. 23, 2021

(54) SYSTEM AND METHOD FOR COMMUNICATING HIGH FIDELITY AIRCRAFT TRAJECTORY-RELATED INFORMATION THROUGH STANDARD AIRCRAFT TRAJECTORY CONVENTIONS

(71) Applicant: THE BOEING COMPANY, Chicago, IL (US)

(72) Inventors: Ernesto Valls Hernandez, Madrid (ES); Francisco A. Navarro Felix, Madrid (ES); Carlos Querejeta Masaveu, Madrid (ES); Jesus Cuadrado Sanchez, Madrid (ES)

(73) Assignee: THE BOEING COMPANY, Chicago, IL (US)

( * ) Notice: Subject to any disclaimer, the term of this patent is extended or adjusted under 35 U.S.C. 154(b) by 158 days.

(21) Appl. No.: 16/128,217

(22) Filed: Sep. 11, 2018

(65) Prior Publication Data

US 2019/0103029 A1 Apr. 4, 2019

(30) Foreign Application Priority Data

Sep. 29, 2017 (EP) ..... 17382648

(51) Int. Cl.
*G08G 5/00* (2006.01)

(52) U.S. Cl.
CPC ..... *G08G 5/0013* (2013.01); *G08G 5/003* (2013.01); *G08G 5/0008* (2013.01);
(Continued)

(58) Field of Classification Search
CPC .... G08G 5/0008; G08G 5/0026; G08G 5/003; G08G 5/0034; G08G 5/0069; G08G 5/0095; G08G 5/0013
See application file for complete search history.

(56) References Cited

U.S. PATENT DOCUMENTS 8,386,175 B2 * 2/2013 Limbaugh ..... G08G 5/0013 340/961
8,818,696 B2 * 8/2014 Klooster et al. ..... G08G 5/0034 701/120

(Continued)

OTHER PUBLICATIONS

Ahyan Samet et al: "Trajectory Based Operations / Unmanned Aircraft Systems with Existing Commercial Avionics", 2016 Integrated Communications Navigation and Surveillance (ICNS), IEEE, Apr. 19, 2016, 10 pgs.

(Continued)

*Primary Examiner* — Dale W Hilgendorf
(74) *Attorney, Agent, or Firm* — Moore IP Law

(57) ABSTRACT

A computer-implemented method and a system for communicating high fidelity (HIFI) trajectory-related information of an aerial vehicle (AV) through standard aircraft trajectory conventions is disclosed. The method includes obtaining, from a first entity, a flight intent containing low fidelity (LOFI) trajectory-related information. The method also includes obtaining intent generation (IG) configuration parameters defining constraints, objectives, or a combination thereof, supplementary to the flight intent, the IG configuration parameters containing HIFI trajectory-related information for closing all degrees of freedom of motion of the AV and configuration. The method includes encoding, using standard aircraft trajectory conventions, the LOFI trajectory-related information from the flight intent and IG configuration parameters as a flight plan and user-defined fields available for information exchange. The method further includes sending, to a second entity, the flight plan and the user-defined fields.

20 Claims, 13 Drawing Sheets

(52) U.S. Cl.
CPC ..... *G08G 5/0026* (2013.01); *G08G 5/0034* (2013.01); *G08G 5/0069* (2013.01); *G08G 5/0095* (2013.01)

(56) References Cited

U.S. PATENT DOCUMENTS

| | | | | |
|---|---|---|---|---|
| 9,786,184 | B2 * | 10/2017 | LaCivita et al. ..... | G08G 5/0013 |
| 2008/0288164 | A1 * | 11/2008 | Lewis et al. ..... | G08G 5/0034 701/120 |
| 2010/0305781 | A1 | 12/2010 | Felix | |
| 2012/0158219 | A1 * | 6/2012 | Durling ..... | G01S 13/933 701/4 |
| 2012/0245834 | A1 * | 9/2012 | Klooster et al. ..... | G08G 5/0034 701/120 |
| 2015/0057915 | A1 * | 2/2015 | LaCivita ..... | G08G 5/0013 701/120 |
| 2016/0012731 | A1 | 1/2016 | Limbaugh | |
| 2016/0093217 | A1 * | 3/2016 | Hale et al. ..... | G08G 5/0013 701/20 |
| 2017/0092135 | A1 * | 3/2017 | Hardt et al. ..... | G08G 5/003 |
| 2018/0005531 | A1 * | 1/2018 | Taylor et al. ..... | G08G 5/0034 |

OTHER PUBLICATIONS

European Search Report dated Apr. 20, 2018 in EP Application No. 17382648.8, 4 pgs.
Communication pursuant to Article 94(3) EPC for application No. 17382648.8 dated May 8, 2018, 6 pgs.

* cited by examiner

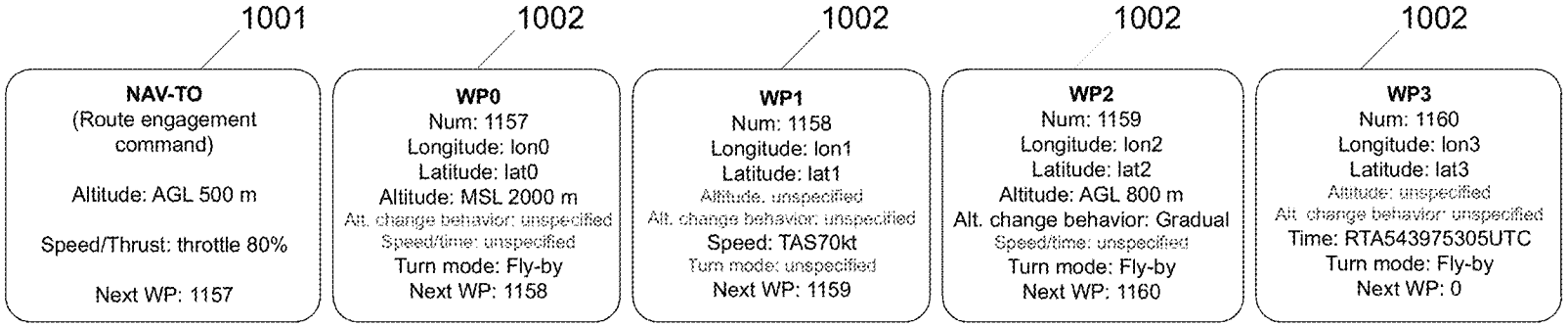
FIG. 10
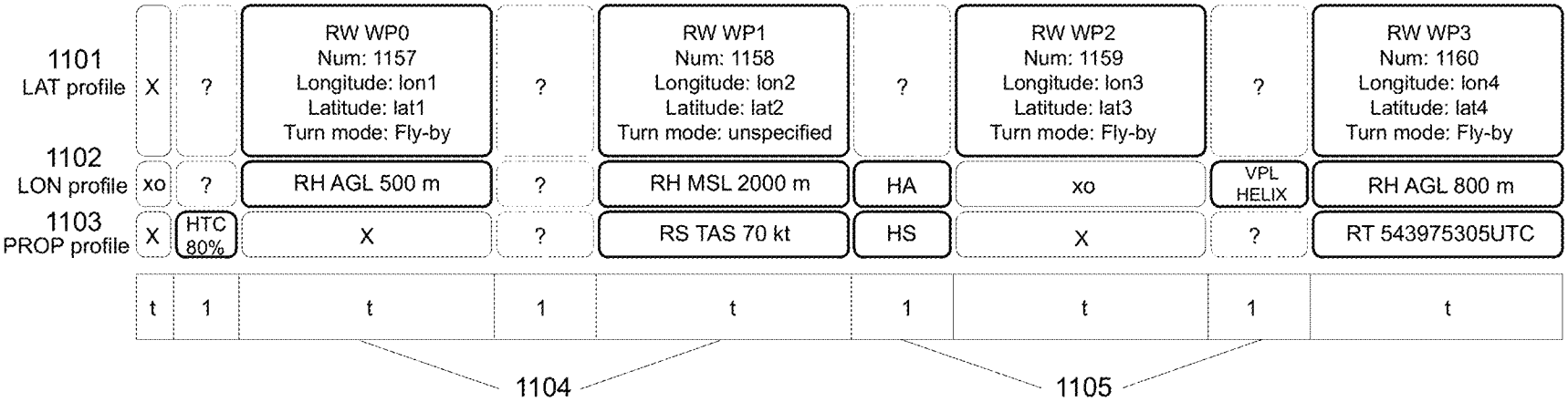
1101
LAT profile
1102
LON profile
1103
PROP profile
t
1
t
1
t
1

| IG CONFIGURATION PARAMETER | | | | | |
|---|---|---|---|---|---|
| # | Description | Value (method #) | Unknown addressed | New unknowns introduced | Profile |
| 1 | Default level of continuity when explicitly required | 0 | Types of explicit triggers | Ø | LAT |
| 2 | Default choice of guidance for straight legs | ORTO (#2) | Q0, Q1, Q2 and Q3 | Ø | |
| 3 | Default turn mode | Fly-by | Q12 | Method? | |
| 4 | Default choice of guidance for fly-by | CIRC (#2) | Q01, Q12 and Q23 | Turn radius ρ? | |
| 5 | Default turn radius for CIRC | 300 m | P0, ρ1 and ρ2 | Ø | |
| 6 | Default choice of guidance for roll-in/out | J-adaption (#2) | How to perform roll-in/out | A, D? | |
| 7 | Default anticipation for J-adaption | 50 m | A | Ø | |
| 8 | Default duration of J-adaption | 100 m | D | Ø | |
| 9 | Default choice of vertical path guidance to meet altitude constraints | HELIX (#2) | Q1 and Q2 | Ø | LON |
| 10 | Default choice of speed guidance to meet speed constraints | SL [ramp] | Q1 | Ø | PROP |
| 11 | Default choice of time guidance to meet time constraints | TL [ramp] | Q2 | Ø | |

FIG. 29

SYSTEM AND METHOD FOR COMMUNICATING HIGH FIDELITY AIRCRAFT TRAJECTORY-RELATED INFORMATION THROUGH STANDARD AIRCRAFT TRAJECTORY CONVENTIONS

FIELD

The present disclosure generally teaches techniques related to exchange of detailed trajectory-related information expressed using a formal language through standard trajectory recipes.

BACKGROUND

An aircraft intent expressed in a formal language also referred to as Aircraft Intent Description Language (AIDL), provides an unambiguous description of an aircraft's intended motion and configuration during a period of flight. The aircraft intent description is usually derived from flight intent.

A flight intent contains more-basic information regarding how the aircraft is to be flown and does not provide enough information to allow an unambiguous determination of aircraft trajectory. Flight intent may be thought of as a generalization of the concept of a flight plan, and so will reflect operational constraints and objectives such as an intended or required route and operator preferences. Generally, flight intent will not unambiguously define an aircraft's trajectory, as the flight intent is likely to contain only some of the information necessary to close all degrees of freedom, i.e., all six degrees of freedom of the aircraft. Put another way, there are likely to be many aircraft trajectories that could be calculated that would satisfy a given flight intent. Thus, flight intent may be regarded as a basic blueprint for a flight, but that lacks the specific details required to compute unambiguously a particular aircraft trajectory. Thus, additional information must be combined with the flight intent to derive the aircraft intent that does allow an unambiguous prediction of the four-dimensional trajectory to be flown by the aircraft.

In this regard, AIDL is a technology that allows the path of an aircraft to be predicted unambiguously. AIDL may be defined as a rigorous formal method to describe the recipe which univocally determines an aerial vehicle trajectory (i.e. aircraft intent). AIDL is intended to support advanced automation in the operation of aerial vehicles. AIDL is a structured and formal language that provides the mechanisms to formulate aircraft intent, which, in the context of trajectory prediction, refers to the information that unambiguously describes how the aircraft is to be operated within a certain time interval.

By expressing aircraft intent according to the AIDL, each instance of aircraft intent defines a unique trajectory for each atmospheric scenario (i.e. given the four-dimensional pressure, temperature and wind fields within which the flight would take place). Consequently, AIDL is considered to support hi-fidelity (HIFI) trajectory definition.

AIDL provides the set of instructions (alphabet) and the rules (grammar) that govern the allowable combinations that express the aircraft intent, and so allow a prediction of the aircraft trajectory. The definition of the alphabet and the grammar rules are based on a mathematical analysis of the trajectory computation process applying the theory of Differential Algebraic Equations. Originally, AIDL was conceived within the Air Traffic Management (ATM) domain to enhance predictability and accuracy on the aircraft trajectory execution in order to facilitate a higher level of automation and autonomy.

Current and legacy ATM solutions use standard, but low fidelity trajectory definitions, in the sense that they cannot describe unambiguously how an aircraft is to be operated within a certain time interval. Thus, aircraft trajectory conventions like those established by ARINC 702A, TCAS/ACAS X CPDLC, ASTERIX, ADS-B and STANAG-4586 are regarded as low-fidelity (LOFI) trajectory definitions. Current legacy and ATM solutions are incompatible with AIDL. Additionally, the field Unmanned Aerial System has new challenges and difficulties where LOFI trajectory information alone is insufficient.

SUMMARY

In a particular implementation, a computer-implemented method for communicating high fidelity (HIFI) trajectory-related information of an aerial vehicle (AV) over a conventional flight plan protocol includes obtaining, from a first entity, a flight intent containing low fidelity (LOFI) trajectory-related information. The method also includes obtaining intent generation (IG) configuration parameters defining constraints, objectives, or a combination thereof, supplementary to the flight intent. The IG configuration parameters contain the HIFI trajectory-related information for closing all degrees of freedom of motion of the AV and configuration. The method includes encoding, using the conventional flight plan protocol, LOFI trajectory-related information from the flight intent and IG configuration parameters as a flight plan and user-defined fields available for information exchange. The method further includes sending, to a second entity, the flight plan and the user-defined fields.

In another particular implementation, a system for communicating HIFI trajectory-related information of an AV through standard aircraft trajectory conventions includes a flight intent encoder configured to obtain, from a first entity, a flight intent containing LOFI trajectory-related information and IG configuration parameters defining constraints, objectives, or a combination thereof, supplementary to the flight intent. The IG configuration parameters contain HIFI trajectory-related information for closing all degrees of freedom of motion of the AV and configuration. The flight intent encoder is further configured to encode, using a conventional flight plan protocol, LOFI trajectory-related information from the flight intent and IG configuration parameters as a flight plan and user-defined fields available for information exchange. The flight intent encoder is further configured to send, to a second entity, the flight plan and the user-defined fields In another particular implementation, a computer-implemented method for communicating HIFI trajectory-related information of an AV through standard aircraft trajectory conventions. The method includes receiving, from a first entity, a flight plan and user-defined fields for additional information exchange in a conventional flight plan protocol. The method further includes decoding the flight plan and user-defined fields and recovering a flight intent containing LOFI trajectory-related information and IG configuration parameters defining constraints, objectives, or a combination thereof, supplementary to the flight intent. The IG configuration parameters contain HIFI trajectory-related information for closing all degrees of freedom of motion and configuration.

In another particular implementation, a system for communicating HIFI trajectory-related information of an AV through standard aircraft trajectory conventions includes a flight intent decoder of the AV. The flight intent decoder is configured to receive, from a second entity, a flight plan and user-defined fields for additional information exchange in a conventional flight plan protocol. The flight intent decoder is further configured to decode the flight plan and the user-defined fields and to recover a flight intent containing LOFI trajectory-related information and IG configuration parameters defining constraints, objectives, or a combination thereof, supplementary to the flight intent. The IG configuration parameters contain HIFI trajectory-related information for closing all degrees of freedom of motion and configuration.

BRIEF DESCRIPTION OF THE DRAWINGS

A series of drawings, which aid in better understanding the disclosure and which are presented as non-limiting examples, are very briefly described below.

FIG. 10 illustrates a schematic of representation a LOFI flight plan in STANAG-4586.

FIG. 11 illustrates an AIDL-like representation captured by a LOFI flight plan in STANAG-4586.

FIG. 29 is a summary table of IG configuration parameters.

DETAILED DESCRIPTION

Figure 1:
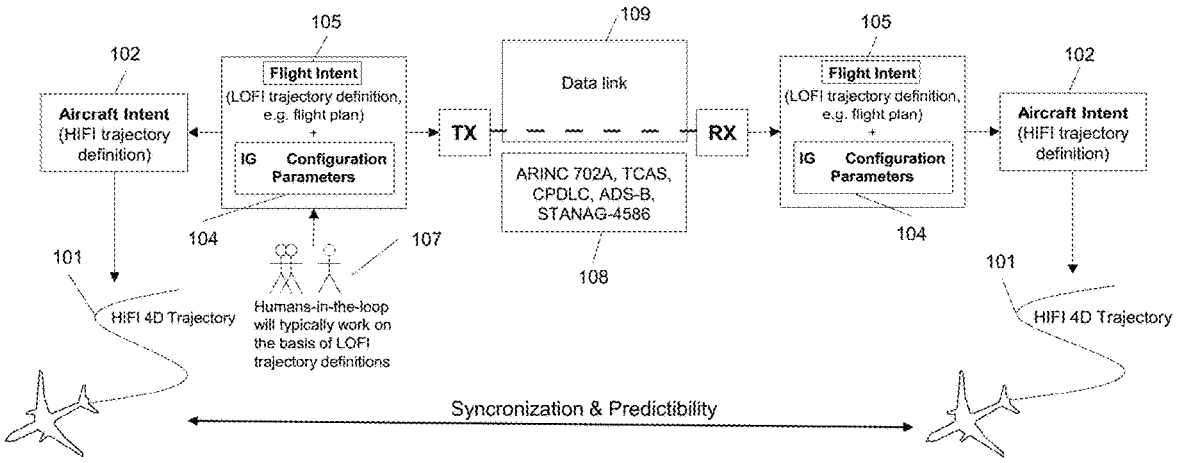
FIG. 1 illustrates AIDL trajectory definition embedded into standard trajectory definitions to be exchanged through legacy communication systems.

The present disclosure was made in view of the situation described before. Emerging and future implementations of communication systems are expected to provide more details to determine an AV trajectory, whereas existing standard formats and legacy Air/Ground (A/G), Air/Air (A/A) and Ground/Ground (G/G) communications systems were originally conceived to support limited exchange of trajectory information (e.g. using less data or a narrow bandwidth).

An aspect of the present disclosure is to provide an implementation to enable the use of Aircraft Intent Description Language (AIDL), which enables hi-fidelity (HIFI) trajectory definitions. AIDL-based technology helps to attain higher levels of automation and autonomy. This implementation will confer several benefits like a better fidelity of aircraft trajectory planning, prediction and control, obtaining unique levels of trajectory synchronization between airborne and ground systems (e.g. respectively autopilots and Ground Control Stations or GCS) as well as between Unmanned Aerial Systems (UAS) instances and Air Traffic Control (ATC).

The implementation of AIDL would also allow a safe separation of aircrafts in congested airspace, such as around airports. Trajectory interoperability and synchronization across trajectory-based tools for modeling, optimization, de-confliction, etc. can also benefit of the present disclosure. The implementation of AIDL may bring unique Autopilot-GCS as well as UAS-ATC trajectory synchronization performance, which benefits mission QoS, flight contingency management and UAS-ATM integration.

Advantageously, the present approach may reduce integration time and life cycle costs. Exchanging HIFI trajectory definitions through existing standards taking advantage of legacy networking architectures and common communication solutions allows for code reuse and seamless integration. The alternative is developing a brand-new approach to HIFI trajectory exchange, which would need to be widely accepted and adopted by the aviation community, which results quite unlikely.

Another aspect of the present disclosure is to provide a method and a system capable of preserving compatibility and interoperability among heterogeneous technologies. Thus, methods and systems of the present disclosure do not cause an intrusive change in entities using existing standards or protocols for trajectory definition and may be implemented without hardware updates.

A further aspect of the present disclosure is to reduce datalink requirements in communications. The present disclosure proposes the exchange of HIFI trajectory definitions (e.g. based on AIDL) embedded into standard (lower-fidelity) ones. The actual exchange of trajectory information reduces to its low-fidelity (standard) representation along with, possibly a set of intent generation configuration parameters, which imply minimum impact in the communication bandwidth.

The greater level of detail in the HIFI trajectory definition is never exposed over the communication datalink.

As result, the present approach improves security without significantly impacting requirements on communication bandwidth. The ability to synchronize full AIDL trajectory definitions and take advantage of them on both sides of the communication pipeline without actually exposing AIDL helps protecting Company's IP and the competitive advantages associated with the AIDL technology.

The present disclosure teaches exchange AIDL trajectory definitions embedded into standard trajectory definitions and exchange formats by:

- automatically generating the aircraft intent on both ends, transmitter and receiver, of the communication pipeline, and
- synchronizing a set of intent generation (IG) configuration parameters that allow replicating the same aircraft intent generation process used on the transmitter side at the receiver side, via a combination of conventions and explicit information exchange using the mechanisms that such exchange methods provide (e.g. user-defined fields).

These techniques will lead to benefits, not only for airlines and other stakeholders but also for passengers and UAV users. Advantageous implementations of the method and system are described in more detail in subsequent sections. The features, functions, and advantages of the present disclosure can be achieved independently in various implementations or may be combined in yet other implementations further details of which can be seen with reference to the following description and drawings.

In this disclosure, the term "LOFI" is to be understood as the not enough trajectory-related information to determinate unambiguously the trajectory that will be flown by the aircraft. A LOFI trajectory will not unambiguously define an aircraft's trajectory due to the fact that the LOFI does not contain the information to close all degrees of freedom, i.e., all six degrees of freedom of the AV. Put another way, there are likely to be many aircraft trajectories that would satisfy a given LOFI trajectory. Thus, a LOFI trajectory may be regarded as a basic blueprint for a flight, but that lacks the specific details required to compute unambiguously a trajectory. "HIFI" is to be understood as the enough trajectory-related information to predict unambiguously the trajectory that will be flown by the aircraft. Thus a HIFI trajectory includes information to allow a unique aircraft intent to be determined and thus a unique trajectory. Thus, the transmitting and receiving information to generate a unique trajectory can enhance air traffic safety and reduce traffic. Additionally, such information can benefit the integration of UAS and UAVs into commercial and regulated airspace.

Various implementations illustrate embedding high-fidelity trajectory definitions into low fidelity and standard trajectory definitions.

FIG. 1 shows how full AIDL trajectory definition may be embedded into low fidelity (LOFI) standard trajectory definitions 108 and exchanged through legacy/current communication systems using data communication link 109 that only support these standards as exchange formats.

Human operators 107 (e.g. pilots, air traffic controllers and designated UAS operators) typically work on the basis of LOFI trajectory definitions 108 (flight plans) that do not usually determine the AV motion unambiguously.

In most cases, LOFI standard trajectory definitions 108 may be represented as and directly mapped to the notion of "flight intent" 105. Generally, a flight intent 105 contains trajectory-related information that does not univocally determine the AV motion, but instead usually incorporates a set of high-level requirements (typically in the form of some sort of conditions and constrains) that define certain aspects that the AV should respect during its motion (e. g. following a certain route, keeping a fixed speed in a certain area).

Normally, a flight intent 105 contains flight segments already augmented by constraints or objectives, for example as already provided by an operator when defining the original flight intent as part of mission plan or the like. However, the operator 107 may enter additional information as intent generation (IG) configuration parameters 104.

These operational objectives and constraints that must be fulfilled by the trajectory are for example: preferred route, operator preferences such as cost-index, standard operational procedures, air traffic management constraints, etc. According to the information that is used directly to generate and augment the flight intent 105, it is possible to group similar elements into two separate types of information: operational and context/user preferences.

IG configuration parameters 104 may be defined as the set of operational and context/user preferences expressed in the way of constraints and objectives that are not contained into the original flight intent 105. IG configuration parameters 104 are optional. A user is free to opt for the use of additional requirements or not.

Figure 2:
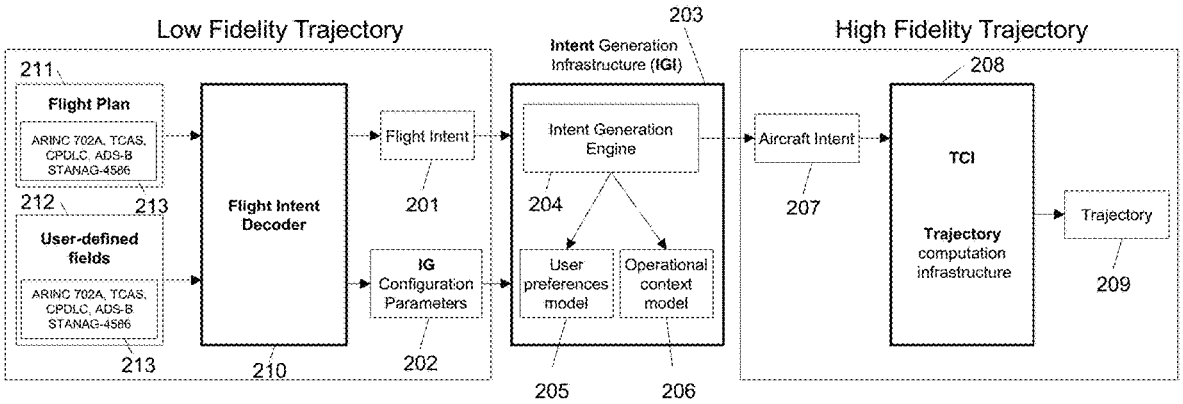
FIG. 2 illustrates a high-level block diagram of the architecture associated with the disclosed teachings.

If the flight intent 105 needs to be supplemented with enough information to allow an aircraft intent to be determined and thus a unique trajectory, a set of standard autocompletion conventions is needed. To this aim, an intent generation infrastructure (IGI) may be used as FIG. 2 shows. One example of a system and method for implementing IGI is disclosed in U.S. Pat. No. 8,798,813 B2, although other methods could be equivalently applied.

In case of using STANAG 4586, the lateral path of an intended trajectory is defined as a set of waypoints, which define a particular mission to be performed by an AV. In order to express such mission in terms of aircraft intent (which can be expressed with AIDL) a complete and unique trajectory is determined mathematically. This includes determining how all the motion control degrees of freedom and, in particular, the lateral motion, are managed in continuous time all over the time interval covered by the AIDL expression.

Thus, determining a unique trajectory involves defining exactly how the AV is going to fly between each waypoint, for instance, through ortodromic lines between waypoints connected by fly-by circular arcs of given turn radius. Such information, which is not contained in the flight plan based on STANAG 4586, shall typically be specified by the user by IG configuration parameters 104.

FIG. 2 shows a high-level representation of several aspects regarding how an intent generation engine 204 uses a flight intent 201, user preferences model 205 and operational context model 206 to provide an aircraft intent 207 as its output. IG configuration parameters 202 may also be an additional input to the intent generation infrastructure (IGI)

203. IG configuration parameters 202 determine (configure) how the user preferences model 205 and/or the operational context model 206 specifically work.

In order to compute the trajectory 209, a trajectory computation infrastructure (TCI) 208 requires as input the aircraft intent 207 previously generated. US 2010/0305781 A1 discloses a proposal for implementing the trajectory computation infrastructure 208. The aircraft intent provides a HIFI trajectory definition with enough information to predict unambiguously the trajectory that will be flown by the AV.

Flight intent decoder 210 uses as a LOFI standard trajectory definition 213 a flight plan 211 and user-defined fields 212 to produce a flight intent 201 and IG configuration parameters 202.

Figure 3:
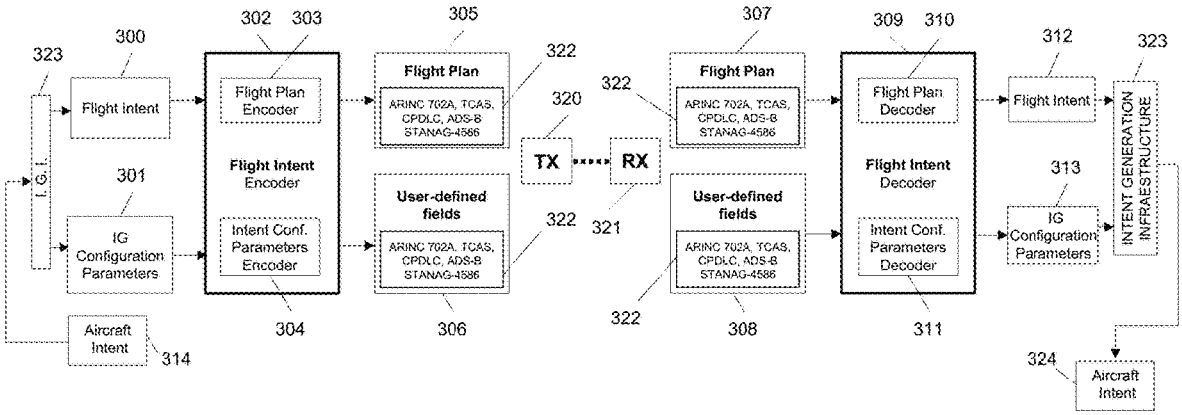
FIG. 3 illustrates a high-level block diagram in which information under different formats is organized, encoded and decoded to be exchanged over legacy systems.

FIG. 3 illustrates how information is encoded and decoded in specific formats in current and legacy systems to allow working with HIFI and LOFI trajectories definitions.

A flight intent encoder 302 includes a flight plan encoder 303 and an IG configuration parameters encoder 304. The flight plan encoder 303 translates a flight intent 300 into a flight plan 305 under a specific format (see LOFI standard trajectory definitions 108 in FIG. 1). IG configuration parameters encoder 304 converts IG configuration parameters 301 into user-defined fields 306 provided by the different standard exchange formats 322 available in the conventional flight plan protocol 108 (e.g. in STANAG 4586 custom user-defined messages may be exchanged by private messages). The flight plan 305 and user defined fields 306 are sent via transmitter 320. A receiver 321 receives the transmitted data as flight plan 307 and user defined fields 308. The aircraft intent 102 that was sent may be retrieved through the data communication link 109, by decoding both flight intent 312 and IG configuration parameters 313 from their corresponding standard trajectory definition and exchange format. Flight intent decoder 309 includes a flight plan decoder 310 and an IG configuration parameters decoder 311.

Optionally, IG configuration parameters 301 and the flight intent 300 can be generated from an aircraft intent 314 via an IGI 323 on the transmitting side. Likewise on the receiving side, IGI 323 can recreate an aircraft intent 324 from the recovered the flight intent 313 and configuration parameters 312.

Therefore, now referring back to FIG. 1, both the sender and the receiver must have the same aircraft intent 102 and the same HIFI trajectory representation 101, without having to expose full AIDL trajectory details. Simply flight plans 211 and user-defined fields 212 are exchanged though standard LOFI trajectory definitions. This solution enables an easy way to interoperate with HIFI trajectories definitions within current and modern ATM/UAS initiatives and legacy systems, allowing the path of an aircraft to be defined and predicted unambiguously and therefore bringing unique synchronization among different systems that share the same trajectory definition.

Figure 4:
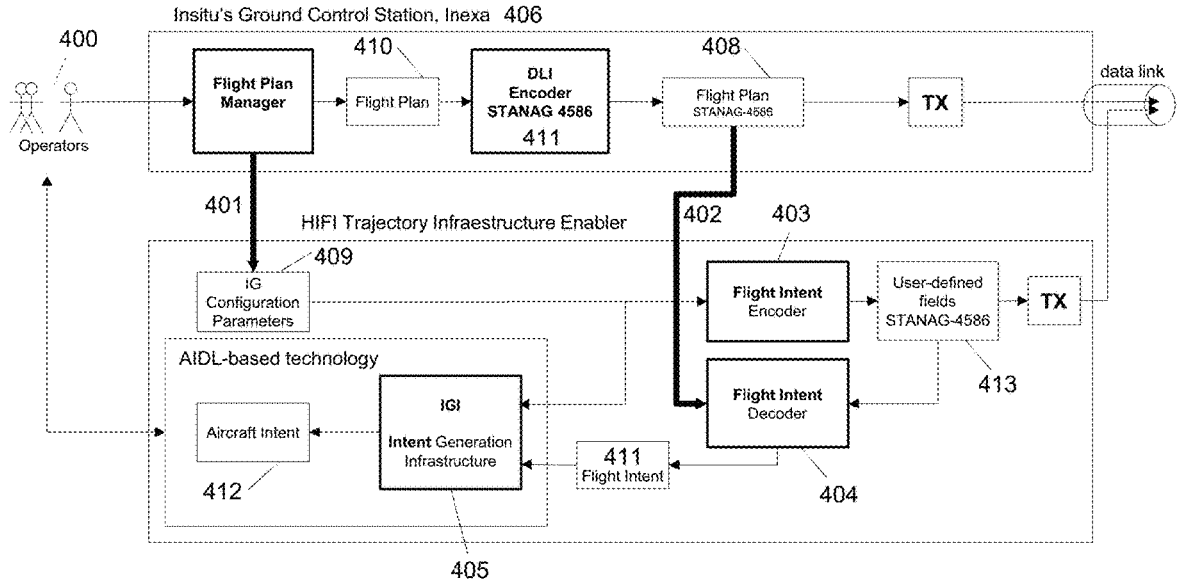
FIG. 4 illustrates a particular platform for Unmanned Aerial Systems (UAS) and a corresponding ground control station.

FIG. 4 illustrates an example of how an implementation may interoperate with legacy systems without an intrusive change and how the implementation may enable the use of AIDL-based technology and its integration with minor to no modification to existing systems. This example deals with the integration and interoperability with a particular platform for UAS and its ground control station (GCS) called Inexa 406, a common law trademark of Insitu Company, designed by Boeing subsidiary Insitu Company. Inexa 406 gives operators tools to control UAS while staying compliant with emerging regulations.

Using the different modules described in the present disclosure, like flight intent encoder 403, flight intent decoder 404, IGI 405, it is possible to set up an adaptive, flexible architecture to enable AIDL-based technology on the existing Insitu's GCS. Only two interactions may suffice to enable the employment of AIDL-based technology:

- A first reception 401 of IG configuration parameters 409 introduced by operators 400 when planning a route (e.g. it can be carried out by an Inexa plugin) may result in generation of an aircraft intent 412 and user defined fields 413.
- A second reception 402 of the resulting flight plan encoded in STANAG 4586 format 408 (it might be implemented as an Inexa plugin 411 or by an external application listening the network).

Advantageously, the proposed architecture is not intrusive; operators 400 may work on LOFI flight plans 410 as usual ignoring the new capabilities provided by the AIDL-based technology.

Figure 5:
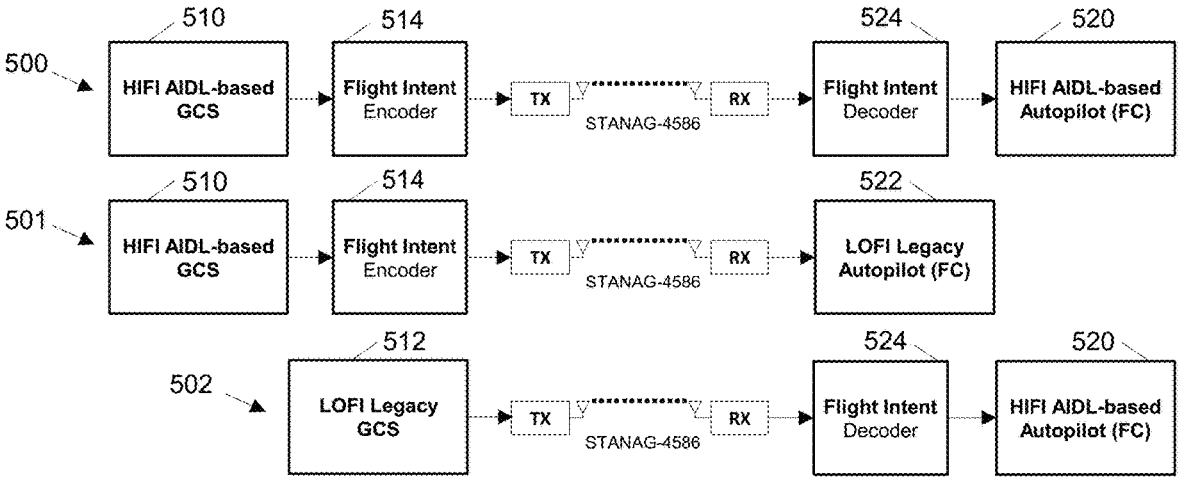
FIG. 5 illustrates three different scenarios for exchanging trajectories in UAS domain.

FIG. 5 illustrates how the present disclosure may interoperate in UAS domain via a flexible architecture with different legacy and future systems in diverse scenarios 500, 501, 502.

In the first scenario 500, both GCS 510 and Autopilot 520 work on HIFI AIDL-based trajectories and exchange trajectories definitions through the existing conventions and standards. A method for controlling a UAV in the present scenario may include the following steps:

1. Creating high fidelity (AIDL) flight trajectory-related information that may be composed of low fidelity flight plan (that is directly mapped to STANAG-4586) and IG configuration parameters.
2. Transmitting low fidelity flight plan and IG configuration parameters via flight intent encoder 514.
3. Receiving low fidelity flight plan and IG configuration parameters via flight intent decoder 524.
4. Generating high fidelity (AIDL) trajectory using a processor configured to perform with low fidelity flight plan and IG configuration parameters as input (One example of a method for implementing IGI is disclosed in U.S. Pat. No. 8,798,813 B2).
5. Transmitting high fidelity (AIDL) trajectory-related information to UAV
6. Controlling UAV using high fidelity (AIDL) trajectory-related information (aircraft intent) through a trajectory computation infrastructure TCI (One example of a trajectory computation infrastructure is disclosed in US 2010/3005781 A1)

In the second scenario 501, GCS 510 works on HIFI AIDL trajectories and exchanges standard trajectories definitions with legacy autopilots 522 that only support LOFI trajectories (e.g. a planned route using STANAG-4586). A method for controlling a UAV in the present scenario may include the following steps:

1. Creating high fidelity (AIDL) trajectory-related information that may be composed of low fidelity flight plan (that is directly mapped to STANAG-4586) and IG configuration parameters.
2. Transmitting low fidelity flight plan and IG configuration parameters via flight intent encoder 514.
3. Receiving low fidelity flight plan. IG configuration parameters will be ignored.
4. Transmitting only low fidelity flight plan to UAV. A LOFI Legacy Autopilot will not support IG configuration parameters.
5. Controlling UAV using low fidelity flight plan In the third scenario 502, a modern HIFI autopilot 520 with an AIDL-based flight control is controlled by a legacy GCS 512 that operates with STANAG-4586. A method for controlling a UAV in the present scenario may include the following steps:

1. Creating a low fidelity flight plan including a list of waypoints.
2. Transmitting low fidelity flight plan.
3. Receiving low fidelity flight plan via flight intent decoder 524.
4. Generating high fidelity (AIDL) trajectory-related information using a processor configured to perform with low fidelity flight plan and IG configuration parameters as input. In the present scenario the IG configuration parameters will not be able to be received from the data link, however might be determined based on full set of conventions adopted off-line.
5. Transmitting high fidelity (AIDL) trajectory to UAV.
6. Controlling UAV using high fidelity (AIDL) trajectory-related information (aircraft intent) through a trajectory computation infrastructure TCI (One example of a trajectory computation infrastructure is disclosed in US 2010/3005781 A1).

The last scenario is particularly instructive; it serves to illustrate how to exchange aircraft intent ignoring the need of IG configuration parameters (e.g. based on a full set of conventions adopted off-line).

Figure 6:
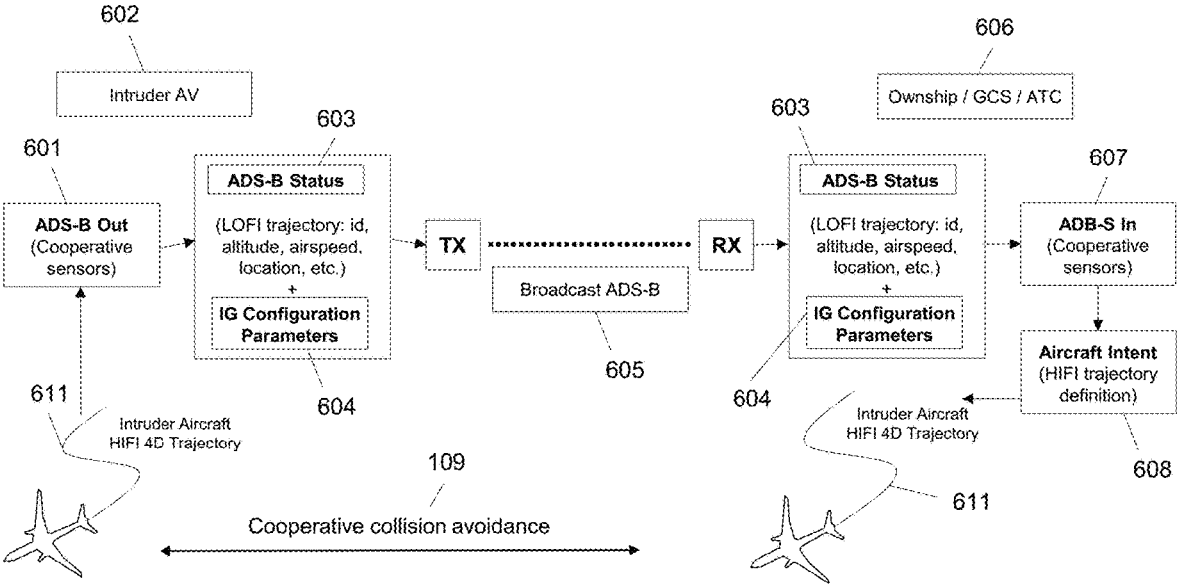
FIG. 6 illustrates an example of cooperative collision avoidance.

FIG. 6 illustrates an AIDL trajectory (HIFI) definition exchanged through ADS-B communication systems 605 that may be applied in trajectory de-confliction & collision avoidance of AVs in case of an intruder AV 602.

The intruder AV 602 equipped with the ABS-B system is capable of sharing its current trajectory within cooperative sensors of ADS-B-Out 601. Thus, an onboard transmitter periodically broadcasts status information 603, such as identification, current position, altitude, heading, and velocity. This AV status information 603 represents a LOFI trajectory definition and may be enriched by using IG configuration parameters 604 to become HIFI. On the other side, a second entity, in this example a nearby AV 606 (but also applicable to CGS or ATC) may recover HIFI intended trajectory as follows. The intruder AV 602 broadcasts a LOFI trajectory definition of its intended trajectory along with IG configuration parameters 604 via ADS-B/out limited bandwidth using legacy trajectory description methods (e.g. ARINC 424). The nearby AV 606 receives the LOFI trajectory 603 and associated IG configuration parameters 604 from the intruder AV 602 via ADS-B/in 607. The nearby AV 606 can then produce an intruder's aircraft intent 608 and thus be aware of intruder's HIFI intended trajectory 611. As a result, predicted trajectories for both intruder AV 602 and nearby AV 606 can be compared to identify potential loss of separation (LoS) with less false and missed alerts expected than doing so based on LOFI trajectories. Consequently, the nearby AV 606 may generate a HIFI collision avoidance maneuver that addresses the LoS identified.

What is more, the nearby AV 606 may eventually execute a HIFI description of the collision avoidance maneuver that effectively addresses the identified LoS. Thus both AVs, nearby AV 606 and the intruder AV 602, may coordinately and cooperatively maneuver to avoid the LoS throughout techniques based on the exchange of LOFI trajectories that can be turned into HIFI ones at both sides of a limited bandwidth communication channel.

Figure 7:
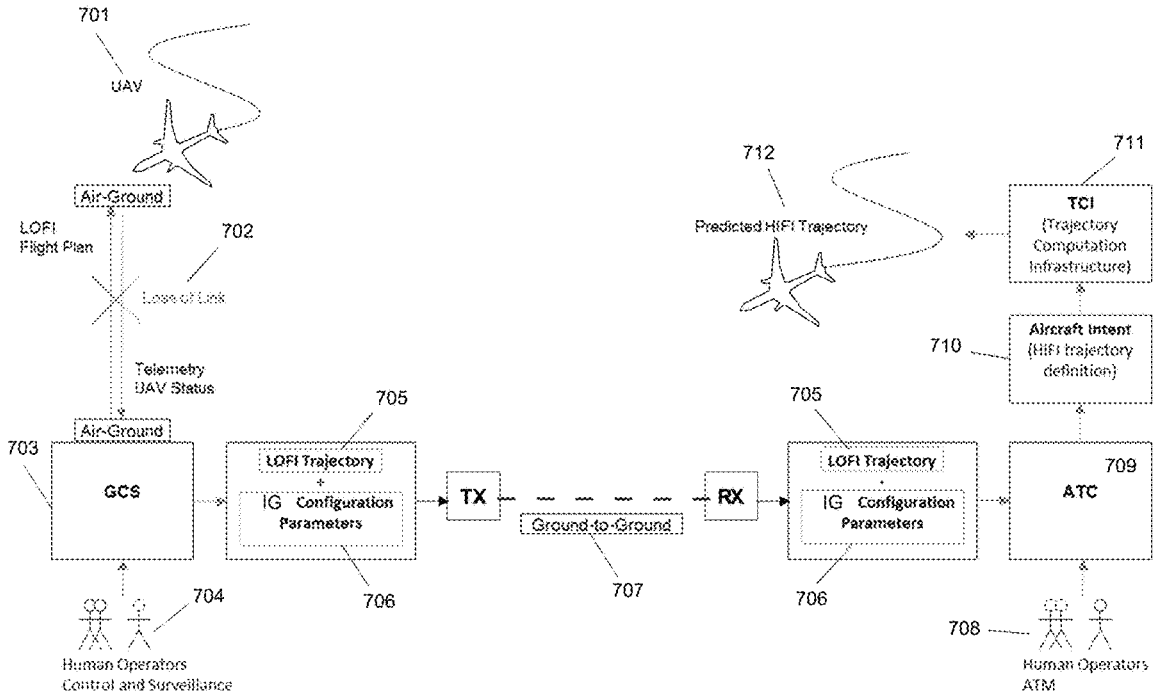
FIG. 7 illustrates an example of surveillance for an Unmanned Aerial Vehicle (UAV) in a loss of link situation.

FIG. 7 depicts surveillance of UAV trajectories in a Loss-of-Link (LoL) situation. This example serves to illustrate how a HIFI trajectory definition (AIDL) may be exchanged through existing Ground-to-Ground communication 707 between GCS 703 and ATC 709 for surveillance purposes.

Specifically, if, as result of a failure (i.e. loss of up/downlinks communication between GCS 703 and UAV 701), the human operators 704 in charge of control and surveillance cannot communicate with the UAV 701. HIFI AIDL trajectory followed by the UAV 701 may be sent through the existing ground-to-ground data communication link 707 from the GCS 703 to the ATC 709, encoding both the LOFI trajectory definition 705, and the IG configuration parameters 706 into the standard trajectory definition and exchange formats that are being used by GCS 703 and ATC 709.

This approach enables the ATC 709 be notified in case of LoL 702 or when some failures occur affecting surveillance. A trajectory computation infrastructure (TCI) 711 as taught in US 2010/0305781 A1, using the generated aircraft intent 710 along with the last position known prior to LoL 702, human operators 708 in charge of ATM may unambiguously calculate with enough accuracy the UAV predicted HIFI trajectory 712.

As a result, operators may effectively plan safe paths for others AVs located close to the danger area. Thus, in order to reduce as much as possible damage to people and infrastructures, operators may create new contingency routes that can also be safe-crash points for the UAV termination if no recovery actions are possible.

Figure 8:
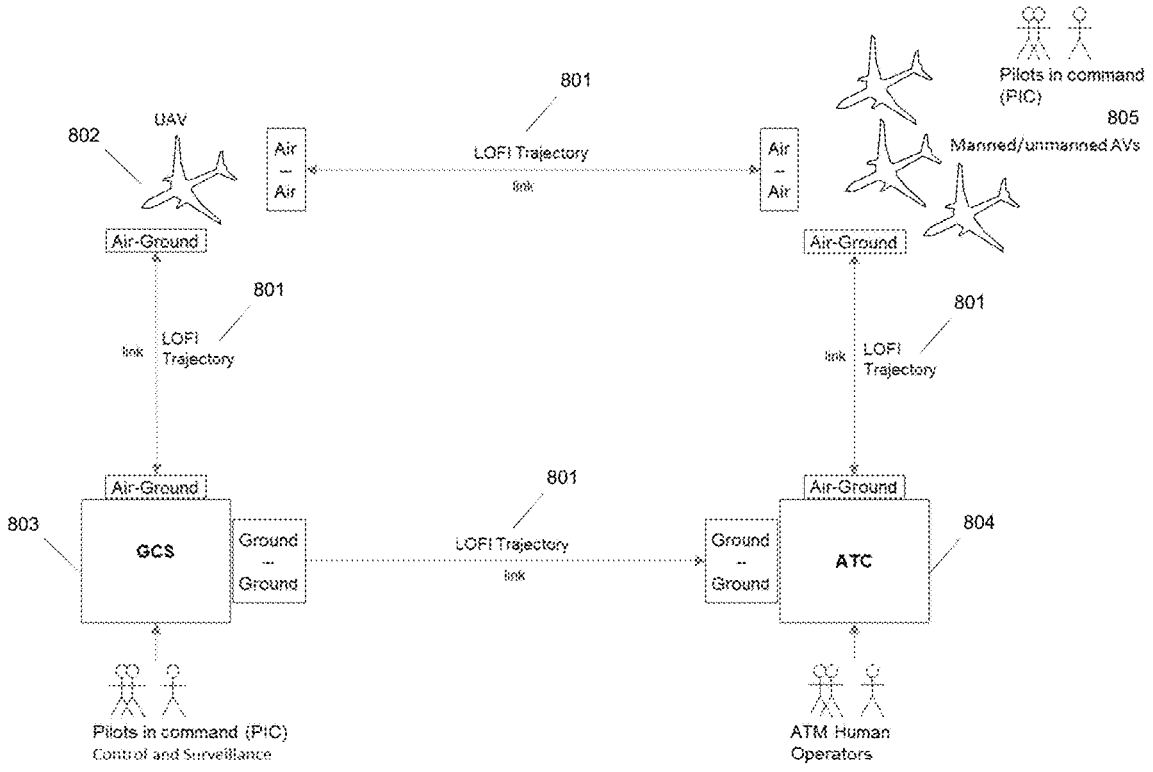
FIG. 8 illustrates integration of conventional air traffic with UAV traffic using existing legacy infrastructure.

FIG. 8 illustrates the current ATM situation where all the main agents implied, namely UAVs 802, Manned/unnamed AVs 805, GCS 803 and ATC 804, are exchanging some kind of LOFI trajectory definition 801. Yet HIFI trajectory definitions may also be exchanged through existing standards, and thus facilitating the integration and compatibility of UAVs into future ATM systems as well as a transition to AIDL-based technology to attain higher automation and better fidelity of aircraft trajectory prediction and control.

This approach may benefit the adoption of HIFI trajectory definitions through existing standards and current conventions improving synchronization between UAS instances and ATC.

Definition of IG Configuration Parameters Throughout the Intent Generation Process The following discussion explains how the intent generation (IG) configuration parameters are determined through the generation process of a HIFI trajectory in AIDL from a LOFI flight plan using NATO STANAG-4586.

According to the STANAG 4586, an AV flight plan is made by one or more routes, each of them composed by a sequence of waypoints (WPs). Routes, in particular, represent the AV path in a 4D space having the waypoints as vertexes. Fourth dimension is specified assigning speed or temporal constraints to selected WPs. At a given time, the AV is following an active route.

Figure 9:
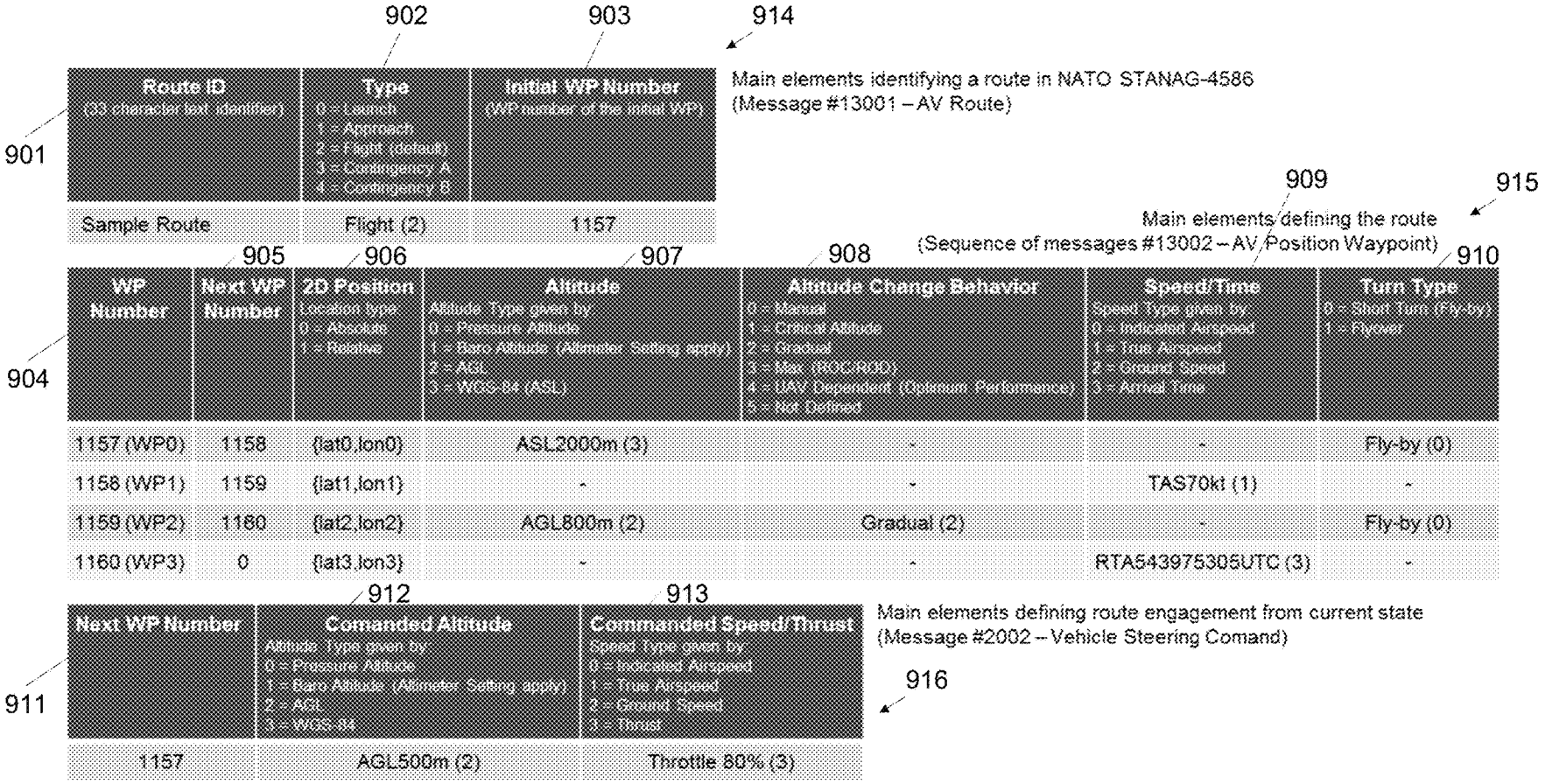
FIG. 9 shows an example of information encompassed by a LOFI trajectory definition using NATO STANAG-4586.

FIG. 9 illustrates information related to the LOFI Trajectory definition in a flight plan of a particular route 901, namely "Sample Route" based on NATO STANAG-4586. In particular messages #13001 914 and #13002 915 are used along with message #2002 916 regarding AV steering command that instructs the engagement of such route from current AV state. Message #13001 914 includes a route type identifier 902. Message #2002 916 includes a commanded altitude identifier 912 and a commanded speed/thrust identifier 913.

Waypoints are the essential trajectory description primitive of STANAG-4586 mission/flight plan protocol. Waypoints may be defined as 2D/3D/4D points that can contain the following information:

Waypoint Number 903, 905 which is a univocal identifier.

2D Position 906 in terms of geodetic {latitude, longitude} referred to WGS-84 or, alternatively, Cartesian {X, Y} coordinates with respect to a relative local Cartesian reference frame.

Altitude 907 in terms of either pressure, altitude, or height; in the latter case it can be referred to either Mean Sea Level (MSL), i.e. Above Sea Level (ASL), or the local ground as Above Ground Level (AGL). It is important to highlight that altitude as constraint captured by STANAG-4586 as part of a given WP definition does actually apply to the next WP of the sequence, except if the Altitude Change Behavior 908 attribute is set to Critical Altitude, in which case a whole spiral up/down flight pattern is inserted at the given WP to ensure altitude adaption locally at such WP.

Speed/Time 908: Regarding speed, it is typically relative to wind (airspeed), in terms of Indicated Air Speed (IAS) or True Air Speed (TAS), or absolute speed referred to the ground, i.e. Ground Speed (GS). Regarding time: typically a Required Time of Arrival (RTA) to the waypoint referred to UTC (Universal Time Coordinated) time reference.

Turn type 910: short turn (i.e. Fly-By) or Fly-Over (i.e. fly-through).

Next WP number 905, 911: WP number of the next WP in the (route) WP sequence.

The WP number 903, 905 is used as univocal identifier and it is the key that permits to build the routes. WP number ranges from 1 to 65535. "0" indicates the end-of-route. As a minimum, WP number and 2D position must be given for each WP designed as part of the route, which outlines the lateral path of the route. Further information such as the turn mode can be optionally provided at each WP to capture more detail about the lateral path. Also, further requirements such as altitude 907 and/or speed/time 909 constraints can optionally be associated with each waypoint to capture some high-level details about the longitudinal and propulsive profiles, respectively addressing $3^{rd}$-dimensional and $4^{th}$-dimensional aspects of the motion of the AV.

A second primitive considered by STANAG-4586 is the so-called loiter waypoint, which essentially can represent either a circle of constant radius also referred to as a Circular Loiter, a hippodrome also referred to as a Racetrack Loiter, depending on the specific parameters that define the loiter pattern. For each loiter waypoint, it is possible to define a Radius, the turn Direction, and the Loiter Time; it is also possible for the Racetrack to define a Length and a Bearing. All loiter patterns are intended at constant altitude (the altitude of the approaching leg) and speed (speed can be specified for the loiter pattern). This example defines a simple route in a flight plan using STANAG-4586, as a sequence of four 2D waypoints numbers 904: 1157 (WP0), 1158 (WP1), 1159 (WP2) and 1160 (WP3), including constraints over the aforementioned waypoints, such as altitude 907 reached at the next waypoints number 905 (500 m, 2000 m and 800 m), speed/time 909 constraints (e.g. TAS 70kt and RTA543975305UTC) and the turn type 910 (in the example, all turns are prescribed as fly-by, except turn at WP1, which is left unspecified). The sample trajectory model also includes the route engagement leg from current AV position at the time that the route is activated (NAV-TO).

FIG. 10 illustrates a LOFI model of the flight plan made in terms of STANAG-4586. As illustrated in FIG. 10, the STANAG-4586 compliant flight plan includes a route engagement command 1001 followed by a sequence of waypoints 1002, each including longitude and latitude as a minimum plus, possibly, the additional information that capture altitude and/or speed/time and/or turn mode constraints.

FIG. 11 illustrates how the information captured by the LOFI STANAG-4586 flight plan may be expressed and modeled by the AIDL. The illustrated model may be considered as the AIDL flight intent derived from the STANAG-4586 trajectory description, however it does not determine a unique trajectory and therefore an aircraft intent. The dashed boxes show all ambiguities and uncertainties that have to be resolved in order to be considered an aircraft intent. Regarding to AIDL, the information captured by each STANAG-4586 command is decomposed as it pertains to the three motion profiles, namely lateral, longitudinal and propulsive associated with the 3 degrees of freedom (DOF) of the motion of the AV.

Unlike STANAG-4586, AIDL defines AV trajectory in terms of sequences called threads of triggers (t) 1104 and instructions (i) 1105, which are the essential AIDL primitives. Triggers 1104 and instructions 1105 are specific to each of the three motion profiles 1101, 1102, 1103, which respectively define how the 3 DOF of the motion of the AV are determined over time.

Triggers 1104 may determine either specific aspects of the motion at a given time (restrictive triggers) or the time at which certain aspect of interest of the motion reaches a value (inspective triggers). Triggers 1104 can also determine a specific time in the motion history based on events that are external to the profile that they belong to (explicit triggers), which enables linking such point in time to extrinsic events (e.g. mission/PL events, ATC or PIC interventions) as well as linking/triggering behavioral changes across the different motion profiles. For instance, initial triggers 1104 in the sequence named with an "X" for eXplicit, as they are all linked to the moment that the pilot in command (PIC) issues the route engagement command. When the time instant inherent to a trigger arrives, the trigger is said to have happened (or have been met), which terminates the active instruction that precedes the trigger in the corresponding profile and activates the one that follows it. Thus, triggers 1104 represent the essential sequence control mechanism that administers how the guidance and control references that determine each DOF of the motion of the AV are sequenced over time. On the other hand, instructions mathematically determine the nature of such control and guidance references (effect). Triggers 1104 and instructions 1105 have specific signatures that govern which alternate sequences of them are considered legal (thread-level lexicon).

Although not illustrated in FIG. 11, the same approach also applies to all additional threads. That is to say, other than the three ones that describe the three motion profiles 1101, 1102, 1103 are needed to describe how the AV configuration aspects, such as landing gear, high-lift devices, speed brackets, reference altitude or any other should be handled over time.

Syntax rules govern which simultaneous combinations of either triggers 1104 or instructions 1105 are compatible. By appropriately sequencing triggers 1104 and instructions 1105 in all applicable profiles 1101, 1102, 1103 and linking triggers 1104 conveniently one can build AIDL trajectory models with arbitrary level of detail (i.e. both LOFI and HIFI).

As previously introduced, when all triggers 1104 and instructions 1105 present in an AIDL trajectory model are completely defined, i.e. no trigger or instruction or any parameter that defines them (if they are parametric) remains unknown, the AIDL model is said to define aircraft intent (HIFI), otherwise, it is said to define flight intent (LOFI). Thus, aircraft intent captures the information that completely and univocally determines the AV motion with a certain level of detail. As such, given an instance of aircraft intent, for each set of initial conditions, AV response/performances and atmospheric scenario there is a unique possible AV motion that such aircraft intent instance gives rise to (i.e. determines). In strict AIDL terminology, the term trajectory is reserved for the notion of AV motion, i.e. the temporal evolution of the AV state over the state-space, i.e. the trajectory in the mathematical sense from Control Theory (AV state as a function of time).

Figure 12:
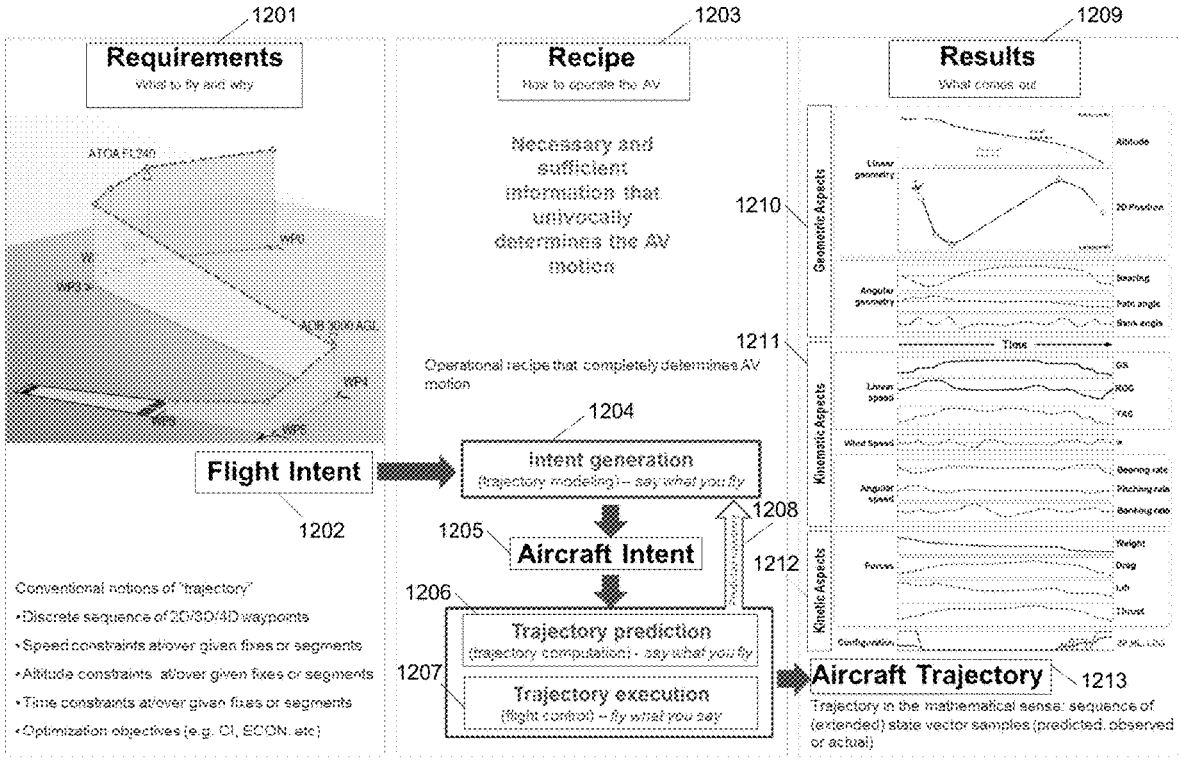
FIG. 12 illustrates a trajectory life-cycle.

FIG. 12 illustrates how the AV trajectory life cycle may look like, as well as what intent generation and IG parameters and configuration parameters may consist upon. Requirements 1201 provide information about what to fly and why. This normally includes a discrete sequence of 2D/3D/4D waypoints, speed constraints and time constraints at/over given fixes or segments, optimization of objectives, etc. in the form of flight intent 1202. Recipe 1203 provides additional information about how to operate the AV. Intent generation 1204 uses flight intent 1202 to obtain aircraft intent 1205. Trajectory prediction 1206 may serve to enhance intent generation 1204 via a predicted trajectory 1208.

AV motion or AV trajectory only becomes evident according to either the trajectory execution 1207 of an aircraft intent recipe 1203 by a given AV in a given atmospheric scenario starting from a given initial state (the so-called actual trajectory) or by a trajectory prediction 1206 where the actual AV response/performances and atmospheric scenario are replaced by respective models representing them (the so-called predicted trajectory). The unicity of aircraft intent 1205 (recipe 1203) in determining the AV trajectory (result 1209) stands for certain given initial conditions, AV and atmospheric scenario. Should any of those three elements vary, a different result 1209 (i.e. a different aircraft trajectory 1213) would be obtained for even the same aircraft intent recipe 1203. On the contrary, in principle, many results might be obtained from a flight intent instance, even if the initial conditions, AV and atmospheric scenario remain unchanged, as what flight intent 1202 captures is trajectory requirements 1201 to a higher or lesser extent, but not to the extent that the guidance, control and AV configuration recipe 1203 gets unambiguously determined. The result 1209 includes geometric aspects 1210, kinematic aspects 1211, and kinetic aspects 1212.

Precisely, what the process of intent generation (IG) 1204 does solve is the ambiguities and uncertainties about the recipe 1203 that still exist at flight intent 1202 level. In general, such process is complex, as it requires making reasonable guesses and assumptions to fill in the gaps based on operational knowledge, as well as, perhaps, performing parametric optimizations supported by an underlying trajectory prediction 1206 capability that also serves to validate the aircraft intent recipe 1203 being formulated. However, regardless its complexity, the ultimate objective of the IG 1204 process is to find out a set of parameters that allow the completion of the missing information in the flight intent 1202 so as to turn it into aircraft intent 1205. Such parameters may, for instance, designate specific choices of instructions or triggers out of the AIDL alphabet that are suitable to complete missing information. Other examples of such parameters include those needed to specify details related to certain given trigger or instruction that are still missing (the so-called specifiers), such as, for instance, the turn radius in a constant radius turn that may have been chosen as the method to implement the fly-by turns.

Consequently, one possibility to reconstruct aircraft intent 1205 from flight intent 1202 is to explicitly share, along with the given flight intent, the corresponding IG parameters generated by a certain IG 1204 capability. This has the advantage that the aircraft intent 1205 is directly obtained from the flight intent 1202 and the companion IG parameters without any need to know how such parameters where obtained, i.e. without the need to share a common IG 1204 capability. But the downside is that, depending of the level of definition of detail in the flight intent 1202, the number of IG parameters can be considerably high.

On the opposite side, should the exact same IG 1204 capability by which the IG parameters were obtained be available, there would be no need to share any IG parameter, as they all could be recreated through repeating the IG 1204 process based on that identical IG capability feed with the same flight intent 1202 as input. However, this time the drawbacks come associated to interoperability issues (not likely that different actors share their IG 1204 capability with others plus there might be actors such as ATC that would need the specific IG capabilities for all the AVs under its responsibility) and/or certifiability issues (e.g. if having to embed the IG capability onboard an AV).

A tradeoff might consist on identifying common assumptions typically made within the IG 1204 process and parameterizing the corresponding IG heuristics in terms of some IG configuration parameters that may relate to default instruction/trigger choices for typical cases that, when shared, would enable replicating the same intent generation process reasonably easily. Then, for most instances of typical cases, there would be no need to recurrently share the same configuration parameter over again, while for the particular cases not covered, the explicit share of IG parameters would be the choice. Moreover, if conventions about which IG configuration parameters to apply are adopted beforehand between the two sides of the communication process intended for trajectory synchronization, there would be no need to further share such parameters. In other words, the more conventional the process of IG 1204 becomes, the lesser the need to explicitly share IG parameters or IG configuration parameters.

Turning to FIG. 11 and the (LOFI) AIDL model above is further discussed illustrated with an example.

AIDL provides restrictive triggers that can directly capture 2D position constraints (RW—Required Waypoint), Altitude (RH—Required Altitude/Height) and Time (RT—Required Time). It has also the ability to capture explicit continuity requirements at given triggers. For instance, let us consider the explicit triggers X that capture the moment in which the PIC issues the steering command to engage the route (NAV-TO). For the lateral 1101 and propulsive profiles 1103, we have used the basic X trigger, because by, design, AIDL implicitly ensures continuity of class 0 through it for the lateral path (which means continuity of geometry) and continuity of class 1 for the propulsive path (which, in this case, means that the magnitude of the speed is continuous). However, class-0 continuity is not, in general, guaranteed for the longitudinal profile 1102, which is the reason to explicitly require it denoting the corresponding trigger 1104 as X0. Higher levels of continuity might have explicitly been requested for the explicit triggers 1104 (such as X1 or X2), in which case, the ensuing instructions 1105 would need to be coherent with such requirements, thereby enforcing that the model of the NAV-TO piece be of higher fidelity. For the sake of simplicity, it is chosen not to require higher level of continuity, which means, discontinuities are accepted in bearing (lateral profile), path angle (longitudinal profile) and speed direction (propulsive profile). Notice that an identical approach is taken for translating into AIDL (explicit) triggers 1104 of the propulsive profile 1103. Due to the lack of speed specification of the STANAG-4586 model in WP0 and WP3, the (implicit) continuity of class 1 (magnitude of the speed) is chosen. Similarly in WP1, where the lack of altitude information referring to the next waypoint translates into an explicit trigger X0 associated (linked) to RW WP2, where the choice is to explicitly require class-0 (continuity of vertical geometry).

One first big difference between AIDL and STANAG-4586 is that, by virtue of the higher granularity of AIDL primitives, it allows associating the altitude constraints with the exact waypoint that they apply to. Thus, RH AGL 500 m is associated with the trigger RW WP0. On the other hand, in STANAG-4586 the altitude constraint is captured in the preceding NAV-TO primitive. RH MSL 2000 m is associated with the trigger RW WP1, while in STANAG-4586 such altitude constraint is captured by the preceding WP0 primitive.

A second important difference with AIDL is that STANAG-4586 primitives merge information related to waypoints with information related to the evolution in between waypoints, which represent a time interval. Waypoints in STANAG-4586 only represent a time instant in the AV trajectory. For instance, as shown in FIG. 10, in NAV-TO 1001, the specification of speed through thrust control (throttle setting at 80% of its maximum) implies that such control law will be exerted until the next WP (WP0) is reached.

Using AIDL as shown in FIG. 11, the above information can be modelled separately by an instruction 1105, namely instruction HTC (Hold Throttle Control) with the specifier 80%. Likewise, with the STANAG-4586 specification of Altitude Change Behavior 2 (Gradual) in WP2 of FIG. 10, which implies that the altitude is controlled so it changes gradually between WP2 and the next waypoint WP3. Whereas AIDL can model this with a Vertical Path Law (VPL) instruction 1105 called HELIX, which essentially provides a guidance law which captures such desired behavior.

A third difference between AIDL and STANAG-4586 as it concerns to the scope of the example being analyzed is that, according to STANAG-4586, when no altitude or speed/time constraints are given at certain WP, it implicitly implies that, respectively, altitude or speed is held between such WP and its next one. In AIDL both guidance laws must be explicitly represented, respectively, by the instructions 1105 Hold Altitude (HA) and Hold Speed (HS).

As shown, the AIDL model of FIG. 8 already captures almost all the information contained in the original STANAG-4586 model, except for the treatment of the Turn Mode information that will be explained later. It is important to notice that, after the IG processing, which essentially consists on translating (i.e. parsing) the information contained in the STANAG-4586 primitives into AIDL triggers and instructions of the applicable profiles, no further uncertainty is concerned with the triggers once the continuity criterion for explicit triggers has been set. Such criterion relates to the use of implicit continuity for explicit triggers, except for those in the longitudinal profile, where class 0 continuity is explicitly required. It can be parameterized with just a three-valued number that represents the minimum level of continuity required for explicit triggers (0, 1 or 2), but such parameter is already an important IG configuration parameter, as it conditions the possible choices of missing instructions that can follow explicit triggers.

Despite the above, significant uncertainty remains in the instructions, which, essentially, reflects the fact that STANAG-4586 primitives, in general, convey little information about the specific guidance and control laws that can be applied so that the AV motion fulfils the given position, altitude and speed/time constraints. All such unknown instructions are represented in the AIDL model of FIG. 9 with a question mark, which shows that the model captures flight intent (i.e. trajectory requirements) rather than a concrete aircraft intent recipe of the trajectory of the AV.

Figure 13:
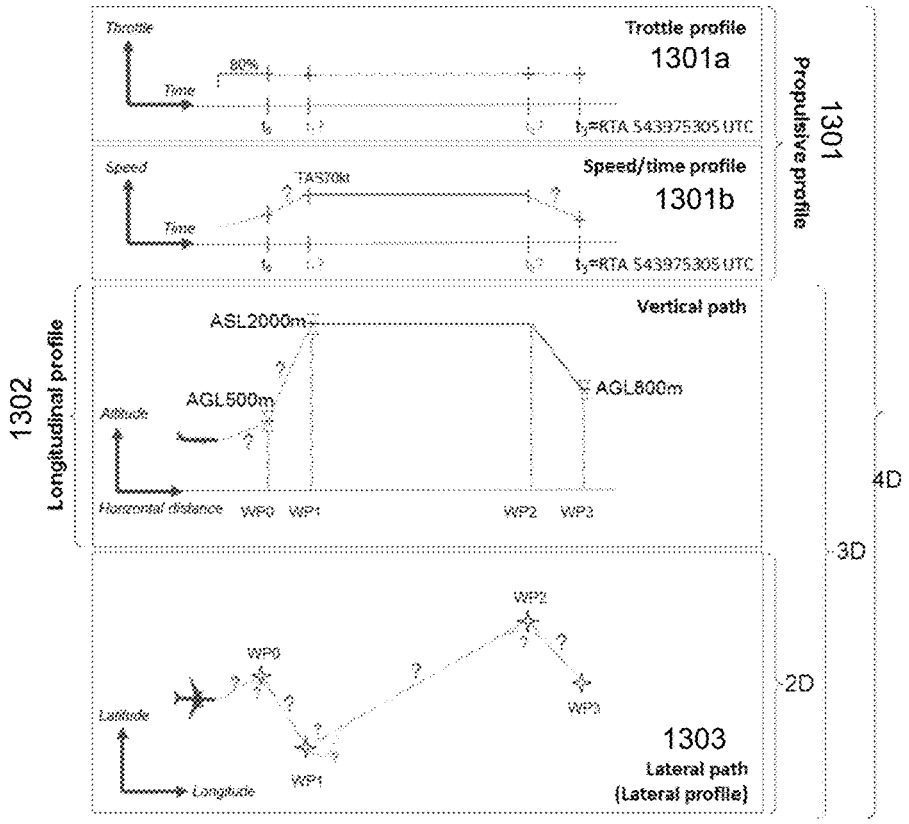
FIG. 13 graphically illustrates a schematic 4D trajectory according to a STANAG-4586 flight plan.

FIG. 13 graphically shows an intuitive representation of the ambiguities or uncertainties inherent to the AIDL flight intent model derived from the STANAG-4586 trajectory description, particularly when trying to depict a 4D trajectory modeled in a 4D space.

Dashed lines with question marks represents uncertainties STANAG-4586 trajectory description for the propulsive profile 1301 (throttle profile 1301*a* and speed/time profile 1301*b*), longitudinal profile 1302 and lateral profile 1303. Due to the limited fidelity of STANAG-4586 trajectory representation, it is not possible to turn these unknown dashed lines of the profiles into concrete continuous ones. In other words, though a discrete number of constraints have been captured, the specific motion of the AV that fulfills such constraints remains largely undetermined. Thus, different GNC (Guidance, Navigation and Control) solutions typically interpret and, thereby, execute the LOFI model in different ways, giving rise to different AV motion histories. For instance, some GNC solutions might choose fly-by as the default solution for the turns for which the turn mode has not been specified while others might choose fly-over. Furthermore, different GNC solutions implement fly-by and fly-over turn modes in different ways. Similar examples can be brought on how different GNC solutions implement dissimilar guidance & control strategies to fulfill altitude and speed/time constraints.

While existing GNC solutions typically do well in the pursue of some sort of optimality, since much of the guidance and control references are implicitly generated on-the-fly, it is hard for third-party actors to accurately predict the 4D trajectories that will result from such LOFI plans. The incomplete HIFI definition of the trajectory of the AV causes the elements (humans & automation systems) that need to be synchronized must make assumptions and take decisions assuring safety via large safety buffets in detriment of other performance aspects such as capacity, efficiency and environmental impact. Also automation is greatly hampered. Thus, the optimality achieved by the GNC solution in virtue of the freedom left by incomplete LOFI trajectory models very often becomes irrelevant in front of the penalties associated with the trajectory amendments needed to ensure safety (e.g. conflict/collision avoidance) or cope with capacity issues (e.g. holding while in-flight or engines on), ultimately derived from the lack of trajectory predictability.

HIFI Trajectory Generation

Figure 14:
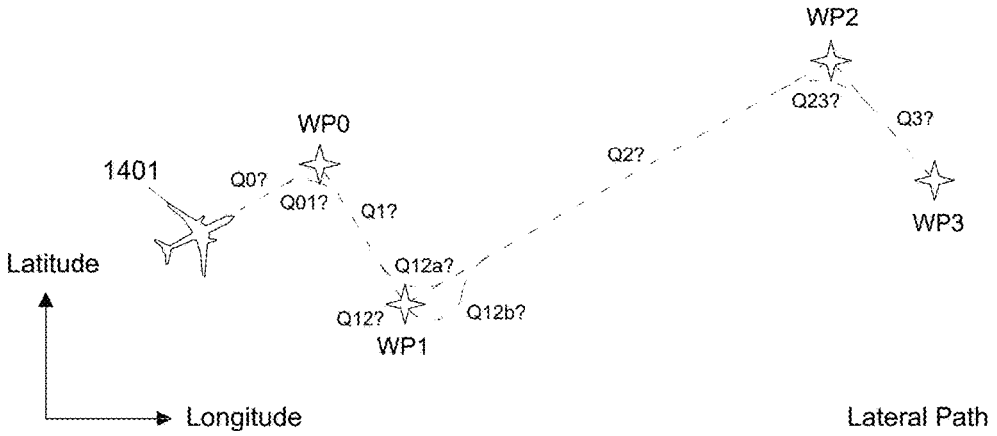
FIG. 14 illustrates uncertainties in a 2D lateral path.

FIG. 14 is a 2D lateral path according to a LOFI trajectory description that only captures the 2D position of the AV 1401 at a discrete set of reference waypoints encompassed by a 2D route definition, namely WP0-WP3.

There is no information captured that determines the geometry of the trajectory in between each pair of consecutive waypoints, as represented in by uncertainties Q0, Q1, Q2 and Q3. The reference waypoints given are certainly not part of the 2D geometry of the trajectory, for those waypoints for which fly-by turn mode is specified. The exact geometry of the turns remain undescribed, as represented by uncertainties Q1 and Q23. For the waypoints for which the turn mode is unspecified the uncertainty about the 2D geometry of the lateral path results even bigger, which is represented by uncertainty Q12, which when addressed, would still give rise to uncertainties Q12a or Q12b.

Figure 15:
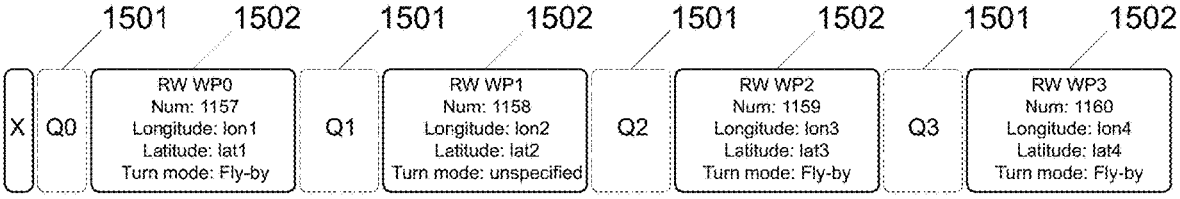
FIG. 15 illustrates an AIDL representation of the lateral path model.

FIG. 15 schematically represents the AIDL model of the 2D lateral path derived from the LOFI STANAG-4586. It reveals the initial gaps that need to be filled in in order to move towards a HIFI model. Parameterized in terms of the parameters 1501 Q0, Q1, Q2 and Q3, such gaps refer to the way of flying the AV in between each pair of consecutive waypoints 1502.

Q0, Q1, Q2 and Q3 are instances 1501 of a certain selection parameter that chooses among possibly different methods to fly the legs in between every consecutive pair of waypoints 1502. Such a parameter is another IG configuration parameter that can be identified, which helps disambiguating how the 2D path is determined in between waypoints 1502.

Typically two approaches may be used to control the lateral path in between two consecutive waypoints 1502:

- A first turn method based on controlling course (the direction of the speed vector) so it points towards the next active waypoint. Once a certain criterion about how such waypoint is considered "met", it is deactivated and the next one in the route is activated and so on and so forth. It may be hard to determine the geometry of the 2D path beforehand, as it would require a good parametric model describing how such control process is performed. For a fixed-wing AV, the control process might include a set of nested PID control loops bank-on-ailerons (with sideslip cancelled by rudder) and course-on-bank, in which case, Q1 would end up being a vector of parameters encompassing the control gains and some key aspects of the dynamics of the AV needed to model the lateral-directional response of the plant that such control applies to.
- A second turn method based on computing the minimum length curve—i.e. the ortodromic—that connects every two consecutive waypoints 1502. This second method implies that the lateral motion is controlled against a fixed geometric reference that can be computed (and therefore, determined and synchronized) beforehand.

In sum, another IG configuration parameter can be a binary-valued one allowing the selection between the two methods, with no additional parameters needed in the case that second method and ortodromic approach is always applied.

Figure 16A:
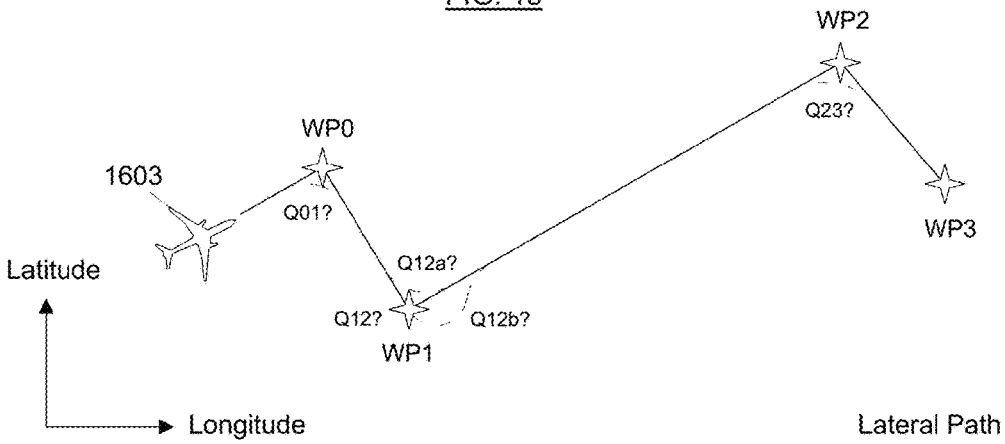
FIG. 16A graphically illustrates several remaining uncertainties in a 2D lateral path.
Figure 16B:
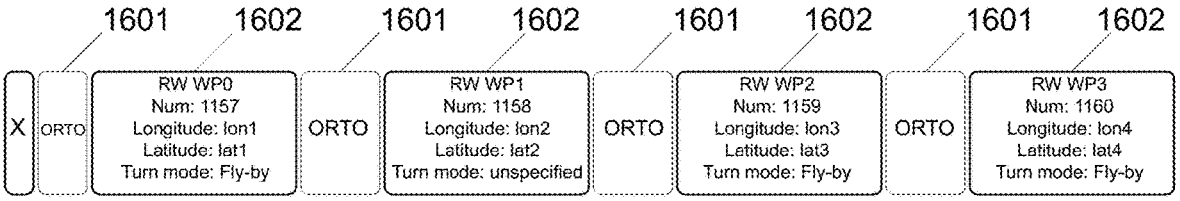
FIG. 16B illustrates a sequence of ortodromic segments (i) of a 2D lateral path in LOFI according to AIDL.

FIG. 16A and FIG. 16B show, as example according to the second turn method, how the IG capability may replace previously unknown parameters 1501 Q0, Q1, Q2 and Q3 by corresponding instances of ORTO. More precisely, a so-called ORTO PP or point-to-point in AIDL terminology.

The next question to be answered is how to model turns at each waypoint. In other words, how to address uncertainties associated with parameters 1601 Q1, Q12/Q12a/Q12b and Q13 graphically shown in FIG. 16A.

Figure 17:
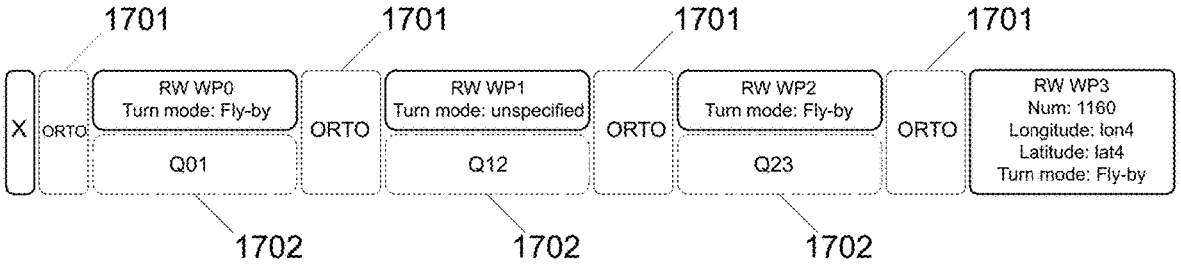
FIG. 17 illustrates a sequence of ortodromic segments (ii) of a 2D lateral path in LOFI according to AIDL.

FIG. 17 shows AIDL LOFI lateral path model as a sequence of ortodromic segments 1701 with the previously unknown parameters 1702 Q0, Q12, and Q23 replaced.

Figure 18:
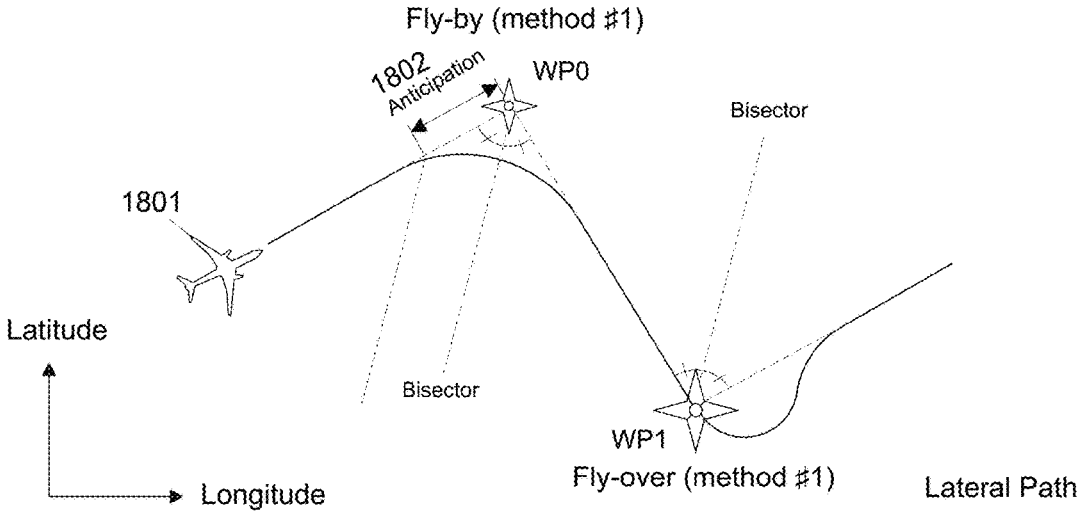
FIG. 18 graphically illustrates a 2D lateral path implementing fly-by and fly-over according to a first method.

FIG. 18 graphically shows a lateral path of an AV 1801 according to a first turn method for the implementation of an IG approach for turns where the course is dynamically controlled. If fly-by is set, the next waypoint WP1 is activated before reaching the currently active waypoint WP0 with certain anticipation 1802, which may be in the form of a distance. Thus, such anticipation 1802 may be another intent configuration parameter. If fly-over is set, the next waypoint WP1 is activated upon reaching the currently active WP0. The next waypoint WP1 may be determined as the current position crosses the bisector of current and next legs by the active waypoint.

Figure 19A:
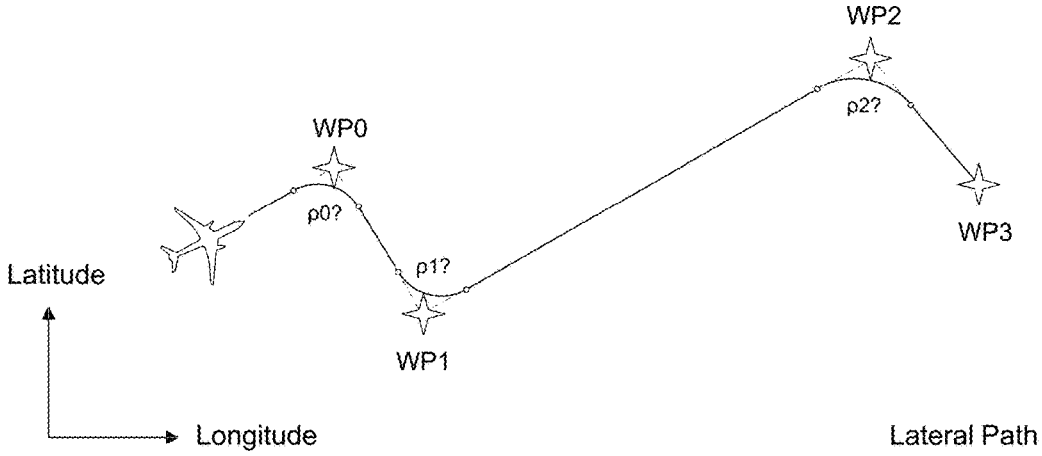
FIG. 19A graphically illustrates a 2D lateral path with a sequence of ORTO and CIRC legs in HIFI according to AIDL.
Figure 19B:
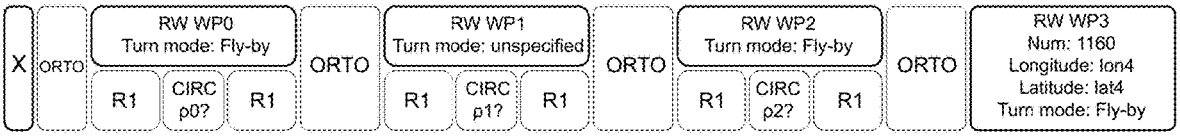
FIG. 19B illustrates a sequence of ORTO and CIRC legs of a 2D lateral path in HIFI according to AIDL.

FIG. 19A graphically shows a lateral path of an AV according to a second turn method which is only valid for the fly-by option. FIG. 19B shows AIDL HIFI representation of the lateral path as a sequence of ortodromic (ORTO) and circular (CIRC) legs.

Thus, constant radius circle tangent to the inbound and outbound ortodromic legs, such radius being another intent generation configuration parameter. Another IG configuration parameter may be a binary-valued one allowing the selection between the two available turn methods. A further IG configuration parameter may be required to choose the turn mode, should such detail be missed in the LOFI trajectory model.

For convenience, it is assumed that such third IG configuration parameter (Q12) sets fly-by by default and second method, i.e. constant radius turn, is always chosen (Q01, Q12a, Q23) with certain radius ($\rho 0$, $\rho 1$, $\rho 2$), i.e. a further IG configuration parameter set to a default value (e.g. 300 m).

Finally, once the fly-by method of constant radius turn has been selected, the specific roll-in and roll-out maneuvers that need to be performed, respectively, at the beginning and end of the constant radius turn so to ensure bank continuity (or, equivalently, radius of curvature of the lateral path) have to be determined. Again, two possible methods may be used:

- First method: For instance, typical RNAV-capable FMS anticipates a certain distance (dynamically computed as a function of AV speed, wind and turn radius) from the point where the turn circle touches the inbound leg (represented in AIDL as a R1 trigger, which requires class-1 continuity in the lateral geometry, i.e. a tangency condition), at which the FMS initiates banking towards a pre-computed target bank angle that is assumed to fit to the given turn radius given the current local wind; then bank angle is controlled so as for the geometry to follow the circular geometry until a point ahead the exit R1 point, where an inverse banking maneuver is initiated to end up capturing the outbound leg.
- Second method: An alternative method to smooth the otherwise discrete jump in bank (or curvature) that would appear in the R1 points could be using a so-called J-adaption curves; a fixed geometry curve that ensures continuity of curvature in the transition from a straight leg to a circular arc and vice-versa. Again, such an approach has the advantage that the geometry of the adaption curve can be computed beforehand, once that of the legs it fits to is known.

Figure 20:
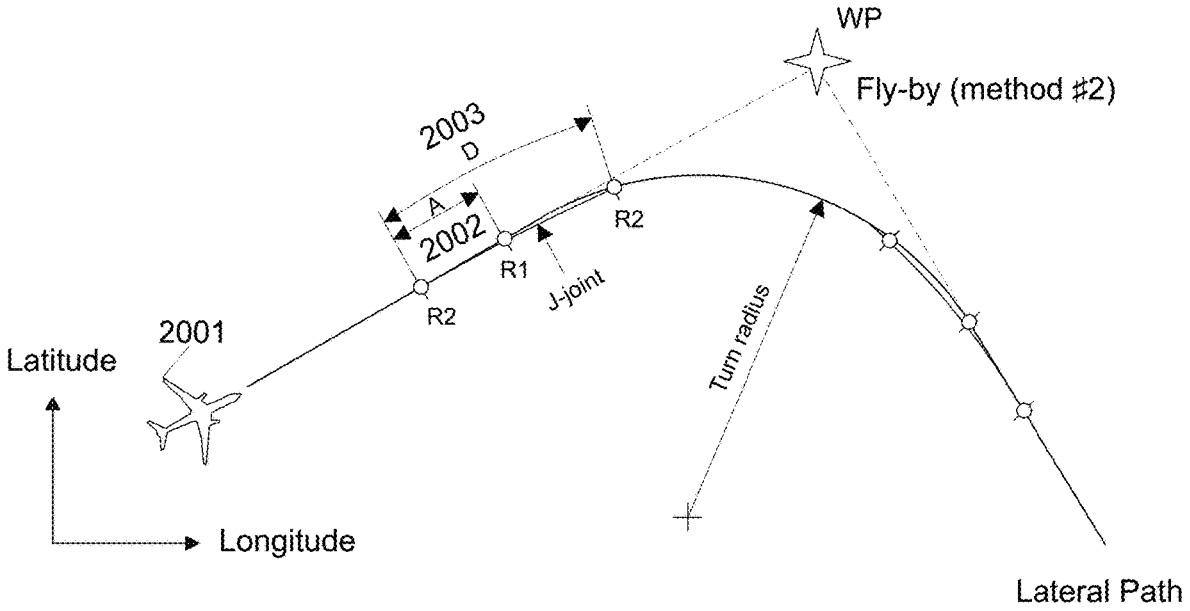
FIG. 20 graphically illustrates an implementation of class-2 continuity adaption according to a second method.

FIG. 20 graphically illustrates an implementation of class-2 continuity adaption according to a second method. A further IG configuration parameter may be yet another binary-valued one that allows selecting between the two methods explained above. Assuming the J-adaption method is always chosen then a typical implementation of such a method requires, for instance, two additional parameters. Said parameters would be added to the list of IG configuration parameters that define the anticipation (A) 2002 to the R1 point and the duration (D) 2003 of the J segment for AV 2001; let us suppose that A=50 m and D=100 m.

Figure 21A:
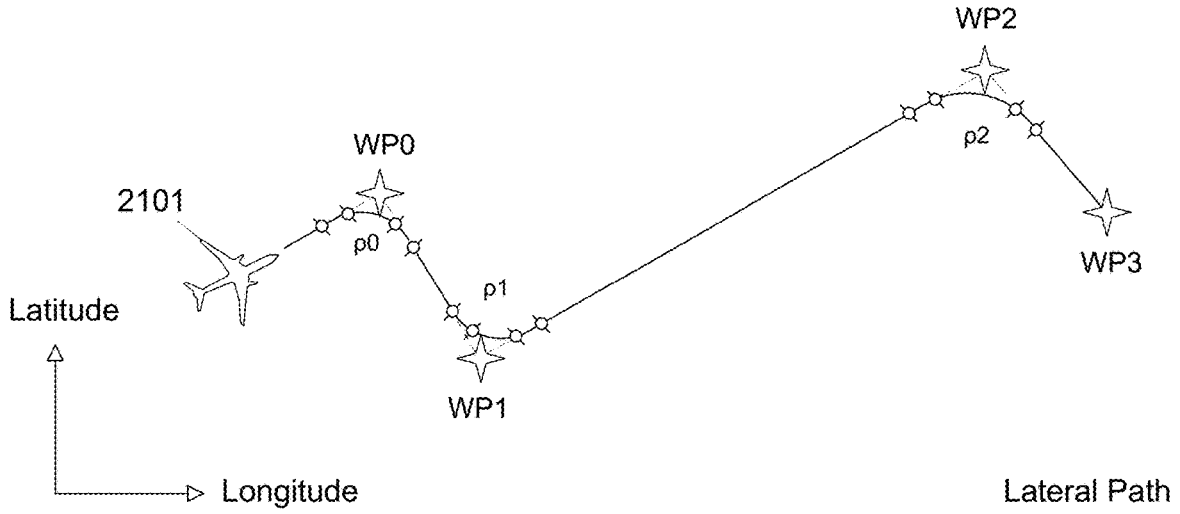
FIG. 21A graphically illustrates a lateral path with a sequence of ORTO and J-CIRC-J legs.
Figure 21B:
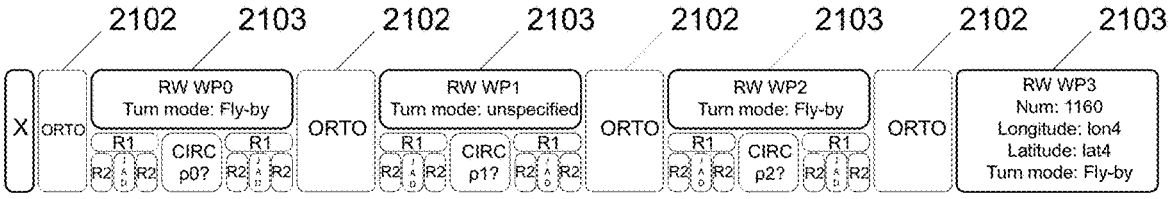
FIG. 21B illustrates a sequence of ORTO and J-CIRC-J legs of a lateral path in HIFI according to AIDL.

FIG. 21A graphically shows a lateral path of an AV 2101. FIG. 21B shows an AIDL HIFI representation of the lateral path as a sequence of ORTO legs 2102 and J-CIRC-J legs.

Noticeably, turn models built for every fly-by waypoint 2103 may represent multiple levels of detail simultaneously.

Figure 22:
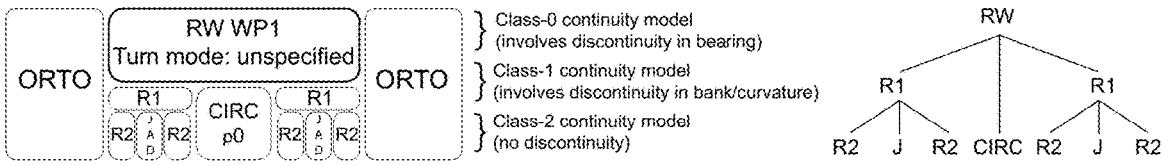
FIG. 22 illustrates an AIDL bridge with several levels.

FIG. 22 schematically illustrates bridges in AIDL. A bridge waypoint trigger represents multiple (nested) levels of detail simultaneously. According to AIDL, patterns that represent nested level of detail simultaneously are called bridges since lower fidelity models "bridge" over higher fidelity ones.

In effect, a satellite view of the trajectory might look like a sequence of connected straight legs (ORTOs) when the connections between consecutive legs are seen roughly as vertexes. When zooming into each vertex, one can see that it splits into two R1 points defining a piece of circular arc that the inbound and outbound legs are tangent at. Finally, when further zooming is applied into such R1 points each one splits in two R2 points and the much smaller J piece adapting curvature can be seen. Thus, trigger RW WP0 bridges over the trigger-instruction-trigger pattern {R1, CIRC,R1}, where each R1 trigger itself bridges over another trigger-instruction-trigger pattern {R2,J,R2}.

Figure 23:
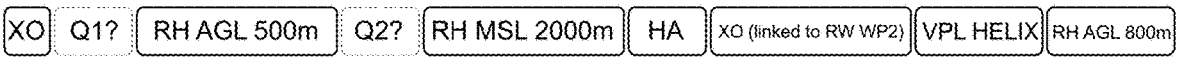
FIG. 23 illustrates an AIDL representation of the vertical path model.

FIG. 23 shows in AIDL model, the vertical path of the intended trajectory defined by STANAG-4586. The first uncertainty found (Q1) comes associated with the (unknown) guidance/control law needed to perform the climb from the altitude at the moment of issuing the NAV-TO command (captured by the X0 trigger) up to the altitude constraint associated with WP0 (captured by the trigger RH AGL 500 m).

Figure 24:
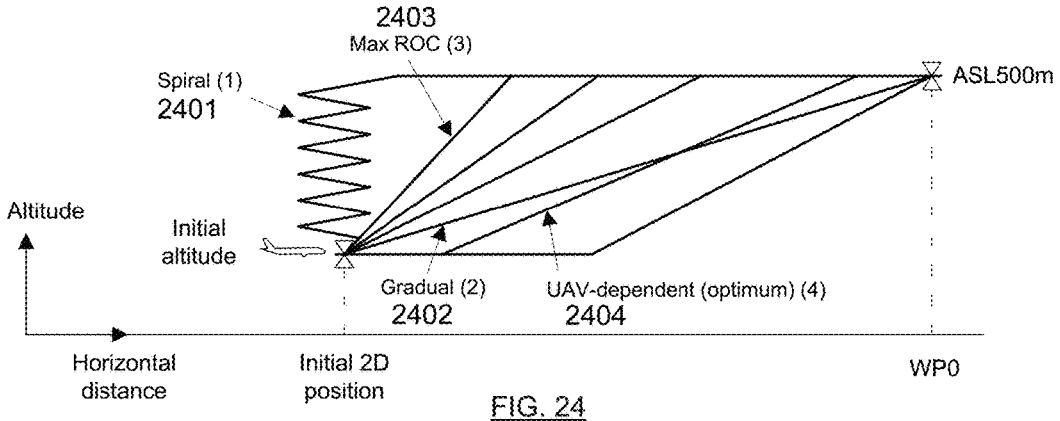
FIG. 24 graphically illustrates uncertainty associated with a missing longitudinal instruction.

FIG. 24 exemplifies uncertainty associated with a missing longitudinal instruction. There are many (in principle, infinite) ways of performing an altitude change. However, there are just four ways that can be captured by STANAG-4586 WP primitives. In effect, only the Gradual (when corresponding to linear altitude change) and Max ROC (Rate of Climb) modes selectable for the Altitude Change Behavior attribute convey enough information as to determine the equivalent guidance/control laws required to close the corresponding DOF beforehand. They are respectively coded in STANAG-4586 with value 2 for Gradual mode 2402 and with value 3 for Max ROC mode 2403. Spiral mode 2401 with value 1 and UAV-dependent mode 2404 with value 4 would require additional information or, otherwise, the IG process should have to fill in the gaps on its own, plus there are many other climb strategies that make operational sense, depending on the situation, besides the four that STANAG-4586 is able to capture.

Figure 25A:
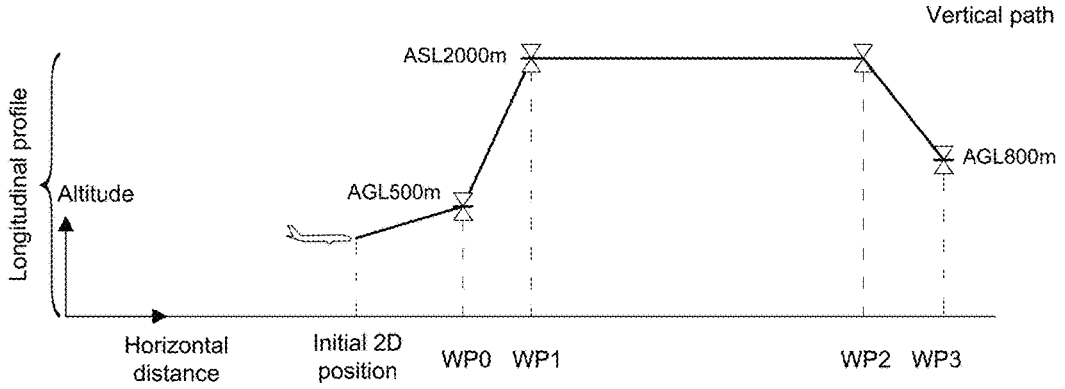
FIG. 25A graphically illustrates an AIDL representation of the longitudinal profile model.
Figure 25B:
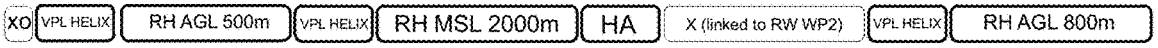
FIG. 25B illustrates a vertical profile in AIDL.

FIG. 25A illustrates an AIDL longitudinal profile model. FIG. 25B is a graphical representation of the corresponding vertical profile.

As it concerns to this example, the Altitude Change Behavior attribute for this leg has been set to code 5, which means, it has been left unspecified. Thus, an additional IG configuration parameter to consider may be the default choice when no details are provided on how to perform a climb in between two given altitudes. The simplest AIDL instruction that complies with such constraints is the aforementioned Vertical Path Law (VPL) instruction called HELIX, which happens to match the expected behavior associated to Altitude Change Behavior attribute set to 2 (Gradual).

The remaining unknown (Q2) can be solved exactly in the same way explained for Q1. With that, AIDL model for the longitudinal profile becomes completely defined. In this example, as all longitudinal instructions belong to either Vertical Path Guidance or Altitude Guidance groups, the vertical geometry of the trajectory being modeled is geometrically defined. Therefore, it can be computed beforehand and is independent from the AV performance/response or atmospheric conditions, excluding exceptions such as if required ROC/ROD exceed performance limitations or e.g. head/tail wind combined with the control exerted in the propulsive profile make it impossible to follow the modeled vertical geometry, which can only be asserted in execution or with the help of a trajectory prediction capability.

Figure 26:
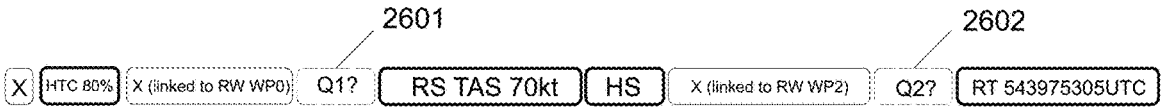
FIG. 26 illustrates an AIDL representation of the propulsive profile model.

FIG. 26 is an AIDL representation of the propulsive profile model. The first uncertainty 2601 found in that profile (Q1) comes associated with an unknown guidance/control law to adapt the speed from the value reached upon arrival to WP0 to the speed constraint given at WP1 (captured by the trigger RS TAS 70 kt).

Again, there are many speed guidance strategies that could fit the required speed evolution. The simplest one (as long as only class 1 continuity is required for the propulsive profile) being a linear variation. AIDL models it as the so-called Speed Law (SL) with the specifier [ramp]. Thus, another IG configuration parameter may be the default choice of SL [ramp] when speed needs to be adjusted within a leg in between two required values.

Regarding the second unknown 2602 found in the propulsive profile (Q2), the subsequent trigger represents a time constraint, which tells the IG process that a Time Guidance strategy should be employed. Time guidance is based on controlling speed/thrust so the AV arrives to the WP at the time required by the given time constraint. AIDL provides several Time Law (TL) instructions, the simplest one for the case when only class-1 continuity is required again being the TL with specifier [ramp]. The last IG configuration parameter found could be the default choice of TL [ramp] when time constraints have to be met over a leg.

Figure 27A:
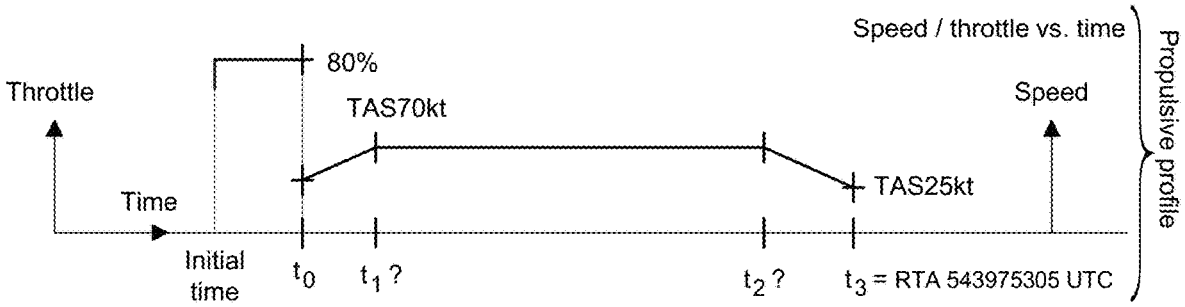
FIG. 27A graphically illustrates a propulsive profile of speed/throttle vs. time.
Figure 27B:
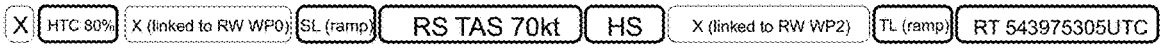
FIG. 27B illustrates an AIDL representation in terms of speed/throttle vs. time.

FIG. 27A graphically illustrates an AIDL propulsive profile of speed/throttle vs. time. FIG. 27B is the associated representation in AIDL terms.

AIDL model for the propulsive profile is completely defined. Notice that either thrust control, speed guidance or time guidance are exerted at a time (consistently with the AIDL grammar rules).

As a result, the entire AIDL model turns from representing flight intent to representing aircraft intent, which now univocally determines the AV trajectory.

Figure 28:
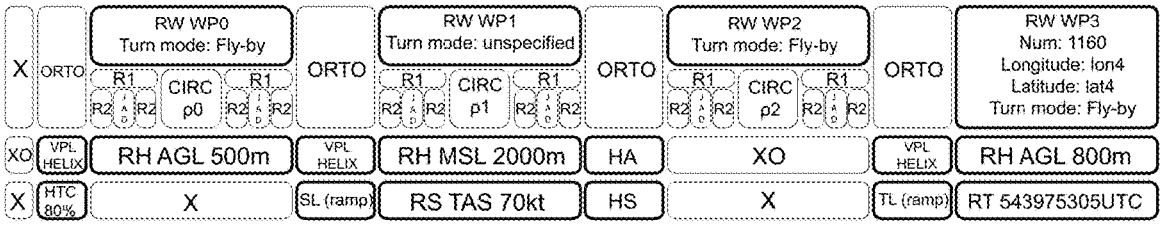
FIG. 28 illustrates an AIDL aircraft intent model.

FIG. 28 shows the final AIDL aircraft intent model. HIFI AIDL model generated throughout the IG process explained already contains much more specific details on how the motion is determined than the original STANAG-4586 model. However, even much more fidelity might have been generated, should a different requirement for continuity of state variables have been set. For instance, while the lateral profile has been designed so class-2 (continuity of bank/curvature) is achieved, the vertical profile has only been required class-0 (continuity of geometry) and the propulsive profile has only been required class-1 (continuity of the magnitude of the speed).

FIG. 29 is a table for the IG configuration parameters identified throughout the intent generation process described above.

As shown, AIDL has much more expressivity than STANAG-4586; in fact, the set of trajectory models that can be built with STANAG-4586 primitives is a subset of the ones that can be built with AIDL.

The discussion above can be made extensive to all existing trajectory definition mechanisms in nowadays like ARINC-424, ARINC-702A, ASTERIX, FIXM, ADS-B, TCAS/ACAS X, etc. Trajectory requirements is typically handled in terms of constrains/objectives to be met. Usually, trajectory definition in current standards include 2D/3D waypoints and some sort of lateral path primitives, altitude/speed/time constrains, cost index, etc., yet they fail to capture 100% of the details of the resulting AV trajectories. In other words, none of them describe the aircraft intent or the operational recipe that univocally determines the AV trajectory understood as the predicted or exhibited history of the (6-DOF) pose of the AV over time.

The present teachings promote an easily integration of HIFI trajectory definitions and AIDL with minor or no modifications to the existing systems. As exemplified, many different areas like aircraft trajectory planning, prediction and control, trajectory synchronization may benefit from AIDL while taking into account interoperability and expanding capabilities of existing systems.

The invention claimed is:

1. A computer-implemented method for communicating high fidelity (HIFI) trajectory-related information of an aerial vehicle (AV) over a conventional flight plan protocol, the method comprising:

obtaining, at a processor from a first entity, a flight intent containing low fidelity (LOFI) trajectory-related information, wherein the flight intent corresponds to a plurality of trajectories of the AV;

obtaining intent generation (IG) configuration parameters defining constraints, objectives, or a combination thereof, supplementary to the flight intent, the IG configuration parameters containing the HIFI trajectory-related information for closing all degrees of freedom of motion of the AV and configuration;

encoding, using the conventional flight plan protocol, LOFI trajectory-related information from the flight intent as a flight plan and the IG configuration parameters as user-defined fields available for information exchange; and sending, from the processor to a second entity distinct from the processor, the flight plan and the user-defined fields, wherein the flight plan and the user-defined fields have a first data size, wherein the flight plan and the user-defined fields are configured to generate HIFI data having a second data size, and wherein the first data size is smaller than the second data size.

2. The computer-implemented method of claim 1, wherein the IG configuration parameters include configuration parameters that allow replicating, at the second entity, an aircraft intent generation process used at the processor.

3. The computer-implemented method of claim 1, further comprising generating the IG configuration parameters and the flight intent from an aircraft intent defining a unique AV trajectory of the AV.

4. The computer-implemented method of claim 1, wherein the flight plan corresponds to the plurality of trajectories of the AV.

5. The computer-implemented method of claim 1, wherein the second entity comprises an unmanned aerial vehicle.

6. The computer-implemented method of claim 1, wherein, the first or second entity is selected among an air traffic control or another AV in an air traffic management environment.

7. A system for communicating high fidelity (HIFI) trajectory-related information of an aerial vehicle (AV) through standard aircraft trajectory conventions, the system comprising:

a computer configured to obtain, from a first entity, a flight intent containing low fidelity (LOFI) trajectory-related information and intent generation (IG) configuration parameters defining constraints, objectives, or a combination thereof, supplementary to the flight intent, wherein the flight intent corresponds to a plurality of trajectories of the AV, and wherein the IG configuration parameters contain the HIFI trajectory-related information for closing all degrees of freedom of motion of the AV and configuration;

the computer further configured to encode, using a conventional flight plan protocol, the LOFI trajectory-related information from the flight intent as a flight plan and the IG configuration parameters as user-defined fields available for information exchange; and the computer further configured to send, to a second entity distinct from the computer, the flight plan and the user-defined fields wherein the flight plan and the user-defined fields have a first data size, wherein the flight plan and the user-defined fields are configured to generate HIFI data having a second data size, and wherein the first data size is smaller than the second data size.

8. The system of claim 7, wherein the system is configured to enable and run, in the second entity, an intent generation process to replicate at least a group of the IG configuration parameters including a level of continuity parameter, a choice of guidance for straight legs parameter, a turn mode parameter, a choice of guidance for fly-by parameter, a turn radius for a circular (CIRC) parameter, a choice of guidance for roll-in/out parameter, an anticipation for J-adaptation curve parameter, a duration of J-adaption curve parameter, a choice of vertical path guidance to meet altitude constraints parameter, a choice of speed guidance to meet speed constraints parameter, a choice of time guidance to meet time constraints parameter, or a combination thereof.

9. The system of claim 7, wherein the computer is further configured to convert IG configuration parameters into user-defined fields of various standard exchange formats available in the conventional flight plan protocol.

10. The system of claim 7, wherein the flight plan corresponds to the plurality of trajectories of the AV.

11. The system of claim 7, wherein the first entity is an air traffic control station and the second entity is another AV.

12. The system of claim 7, wherein the first entity is a ground control station and the second entity is another AV.

13. A computer-implemented method for communicating high fidelity (HIFI) trajectory-related information of an aerial vehicle (AV) through standard aircraft trajectory conventions, the method comprising:

receiving, from a first entity, a flight plan and user-defined fields for additional information exchange in a conventional flight plan protocol, wherein the flight plan and the user-defined fields have a first data size; and decoding the flight plan and user-defined fields and recovering a flight intent containing low fidelity (LOFI) trajectory-related information from the flight plan and intent generation (IG) configuration parameters from the user-defined fields, the IG configuration parameters defining constraints, objectives, or a combination thereof, supplementary to the flight intent, wherein the IG configuration parameters contain the HIFI trajectory-related information for closing all degrees of freedom of motion and configuration, wherein the flight intent corresponds to a plurality of trajectories of the AV; and generating HIFI data based on the flight intent and the IG configuration parameters, wherein the HIFI data has a second data size, and wherein the first data size is smaller than the second data size.

14. The computer-implemented method of claim 13, further comprising generating an aircraft intent from the flight intent and configuration parameters.

15. The computer-implemented method of claim 13, wherein the IG configuration parameters include a level of continuity parameter, a choice of guidance for straight legs parameter, a turn mode parameter, a choice of guidance for fly-by parameter, a turn radius for a circular (CIRC) parameter, a choice of guidance for roll-in/out parameter, an anticipation for J-adaptation curve parameter, a duration of J-adaption curve parameter, a choice of vertical path guidance to meet altitude constraints parameter, a choice of speed guidance to meet speed constraints parameter, and a choice of time guidance to meet time constraints parameter.

16. A system for communicating high fidelity (HIFI) trajectory-related information of an aerial vehicle (AV) through standard aircraft trajectory conventions, the system comprising:

a computer of the AV configured to receive, from a second entity, a flight plan and user-defined fields for additional information exchange in a conventional flight plan protocol, wherein the flight plan and the user-defined fields have a first data size;

the computer further configured to decode the flight plan and the user-defined fields and to recover a flight intent containing low fidelity (LOFI) trajectory-related information from the flight plan and intent generation (IG) configuration parameters from the user-defined fields, the IG configuration parameters defining constraints, objectives, or a combination thereof, supplementary to the flight intent, wherein the IG configuration parameters contain the HIFI trajectory-related information for closing all degrees of freedom of motion and configuration, wherein the flight intent corresponds to a plurality of trajectories of the AV; and the computer further configured to generate HIFI data based on the flight intent and the IG configuration parameters, wherein the HIFI data has a second data size, and wherein the first data size is smaller than the second data size.

17. The system of claim 16, wherein the LOFI trajectory-related information in the flight intent enables, in the second entity, an intent generation process to replicate at least a group of the IG configuration parameters defining the constraints, the objectives, or the combination thereof, supplementary to the flight intent.

18. The system of claim 16, wherein the HIFI data comprises an aircraft intent defining a unique AV trajectory.

19. The system of claim 18, wherein the aircraft intent indicates a HIFI intended trajectory of the AV, and further comprising a trajectory infrastructure of the AV, the trajectory infrastructure configured to determine the HIFI intended trajectory of the AV based on the aircraft intent.

20. The system of claim 18, wherein the aircraft intent indicates a HIFI intended trajectory of the second entity, and further comprising a trajectory infrastructure of the AV, the trajectory infrastructure configured to determine the HIFI intended trajectory of the second entity based on the aircraft intent, wherein the AV is configured to:

compare the HIFI intended trajectory of the second entity and a HIFI intended trajectory of the AV to identify a loss of separation (LoS) associated with the AV and the second entity; and generate a HIFI collision avoidance maneuver that addresses the LoS.

* * * * *